US007686415B2

(12) United States Patent
Sugahara

(10) Patent No.: US 7,686,415 B2
(45) Date of Patent: Mar. 30, 2010

(54) LIQUID DROPLET JETTING APPARATUS

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 414 days.

(21) Appl. No.: 11/536,068

(22) Filed: Sep. 28, 2006

(65) Prior Publication Data

US 2007/0070101 A1 Mar. 29, 2007

(30) Foreign Application Priority Data

Sep. 28, 2005 (JP) ..... 2005-282733

(51) Int. Cl.
*B41J 29/38* (2006.01)

(52) U.S. Cl. ..... 347/20; 347/28; 347/73

(58) Field of Classification Search ..... 347/28–29, 347/20, 73, 74, 9

See application file for complete search history.

(56) References Cited

U.S. PATENT DOCUMENTS

| | | | | |
|---|---|---|---|---|
| 5,929,877 | A * | 7/1999 | Hetzer et al. | 347/28 |
| 6,293,639 | B1 * | 9/2001 | Isamoto | 347/10 |
| 7,004,555 | B2 | 2/2006 | Sugahara | |
| 2003/0179258 | A1 | 9/2003 | Friere et al. | |
| 2004/0046825 | A1 | 3/2004 | Sugahara | |
| 2005/0093919 | A1 | 5/2005 | Takatsuka et al. | |
| 2005/0200647 | A1 | 9/2005 | Sugahara | |
| 2006/0023035 | A1 | 2/2006 | Sugahara | |
| 2006/0197810 | A1 * | 9/2006 | Anagnostopoulos et al. | 347/74 |

FOREIGN PATENT DOCUMENTS

| | | |
|---|---|---|
| EP | 1 398 155 A1 | 3/2004 |
| EP | 1 574 343 A2 | 9/2005 |
| EP | 1 621 345 A1 | 2/2006 |
| JP | 2004122775 | 4/2004 |
| JP | 2005254579 | 9/2005 |
| NL | 8902304 A | 4/1991 |

OTHER PUBLICATIONS

European Search Report received on Mar. 26, 2008, in corresponding European Patent Application No. 06020316.3.

* cited by examiner

*Primary Examiner*—Lam S Nguyen
(74) *Attorney, Agent, or Firm*—Baker Botts L.L.P.

(57) ABSTRACT

An ink-jet printer includes an ink-jet head which includes a nozzle, a main liquid droplet trapping section 30 which traps only a main liquid droplet, and a cover member which surrounds a space in which a satellite liquid droplet which is jetted from a nozzle at the same time when the main liquid droplet is jetted, flies. It is possible to suppress a decline in an accuracy of a landing position of the satellite liquid droplet, caused due to a change in a trajectory of flying of the satellite liquid droplet due to an effect of a flow of air in the space. Accordingly, it is possible to provide a liquid droplet jetting apparatus which is capable of controlling accurately the landing position of a very small satellite liquid droplet.

20 Claims, 20 Drawing Sheets

LIQUID DROPLET JETTING APPARATUS

CROSS REFERENCE TO RELATED APPLICATION

The present application claims priority from Japanese Patent Application No. 2005-282733, filed on Sep. 28, 2005, the disclosure of which is incorporated herein by reference in its entirely.

BACKGROUND OF THE INVENTION

1. Field of the Invention

The present invention relates to a liquid droplet jetting apparatus which jets liquid droplets.

2. Description of the Related Art

In recent years, in a field of liquid droplet jetting apparatuses which jet liquid droplets, a technology for jetting a very small liquid droplet has been required. For example, in an ink-jet head which jets ink onto a recording paper, for recording an image of a high quality, a technology for jetting a very small droplet has been required. Moreover, a technology to jet an extremely small liquid droplet is required also in cases such as forming a fine wiring pattern on a substrate by jetting an electroconductive paste, forming a high definition display by jetting an organic light emitting body on a substrate, or forming a very small optical device of an optical wave guided by jetting an optical plastic (optical resin) on a substrate.

SUMMARY OF THE INVENTION

Inventors of the present invention have proposed a liquid droplet jetting apparatus (refer to U.S. Pat. No. 7,004,555 for example) which is capable of forming a very small dot on a recording medium by making to land on a recording medium such as a recording paper, only a liquid droplet (satellite droplet) smaller than a main droplet, which is jetted along with a jetting of the main droplet when the big droplet (main liquid droplet) is jetted from a nozzle. This liquid droplet jetting apparatus includes two liquid droplet jetting sections, each section capable of jetting a droplet, and these two liquid droplet jetting sections are disposed such that trajectories of droplets jetted from respective nozzles intersect mutually. Moreover, after the main liquid droplet and the satellite liquid droplet are jetted in the same direction from one liquid droplet jetting apparatus, a liquid droplet jetted from the other liquid droplet jetting section are allowed to collide with the main liquid droplet. Thus, by allowing the direction of flying of the main liquid droplet to be different from the direction of flying of the satellite liquid droplet by changing the direction of flying of the main liquid droplet, it is possible to make only the small satellite liquid droplet land on the recording medium.

Since a volume of a satellite liquid droplet is very small and a satellite liquid droplet is very light in weight, while traveling from the nozzle up to the recording medium, the flying trajectory of the satellite liquid droplet is susceptible to change due to dust which is dispersed, and a flow of a gas (air) in a space in a surrounding area. Therefore, there is a problem of a decline in accuracy of a landing position at which the satellite liquid droplet is landed.

An object of the present invention is to provide a liquid droplet jetting apparatus which is capable of suppressing a decline in the accuracy of a landing position of the satellite liquid droplet.

According to a first aspect of the present invention, there is provided a liquid droplet jetting apparatus which jets, onto an object, a main liquid droplet and a satellite liquid droplet which has a volume smaller than a volume of the main liquid droplet, comprising;

a nozzle;

a flying trajectory setting mechanism which sets a flying trajectory of the main liquid droplet jetted from the nozzle and a flying trajectory of the satellite liquid droplet jetted from the nozzle;

a shielding body which shields a space in which the satellite liquid droplet jetted from the nozzle flies; and a main liquid droplet trapping section which traps only the main liquid droplet, and which is arranged in the space at a position at which the main liquid droplet trapping section makes contact with the main liquid droplet jetted from the nozzle and has no contact with the satellite liquid droplet.

According to the first aspect of the present invention, after the main liquid droplet and the satellite liquid droplet which has the volume smaller than the volume of the main liquid droplet are jetted from the nozzle, it is possible to trap only the main liquid droplet by the main liquid droplet trapping section, and to make only the satellite liquid droplet having the liquid droplet volume smaller, land on the object (recording medium). Therefore, it becomes possible to form an extremely small dot on the recording medium. Moreover, since the space in which the satellite liquid droplet flies is shielded by the shielding body, it is possible to suppress a decline in an accuracy of a landing position, due to a change in the flying trajectory of the satellite liquid droplet because of an influence of a flow of gas such as air in a surrounding thereof. Furthermore, since the main liquid droplet trapping section which traps the main liquid droplet is also covered by the shielding body, a humidity (moisture content) of a space covered by the shielding body is maintained to be high, and it is possible to prevent from getting dried the main liquid droplet which has landed on the main liquid droplet trapping section. Therefore, since a fluidity of the main liquid droplet becomes high, for example, it becomes easy to reuse upon recovering the main liquid droplet which has landed on the main liquid droplet trapping section.

In the liquid droplet jetting apparatus of the present invention, the main liquid droplet trapping section may be formed integrally with the shielding body. In this case, since the number of components is decreased, a reduction in a cost becomes possible. Moreover, since it becomes easy to form the main liquid droplet trapping section and the shielding body in a compact size, it is possible to shorten a distance between the nozzle and the recording medium, and to reduce a size of the liquid droplet jetting apparatus.

In the liquid droplet jetting apparatus of the present invention, a through hole which allows only the satellite liquid droplet to pass through may be formed in the shielding body at an area which covers the space from a side of the object. In this case, the space in which the satellite liquid droplet flies is covered by the shielding body also from a side of the recording medium, and a flow of a gas around the satellite liquid droplet which flies, is small. Therefore, the decline in the accuracy of the landing position of the satellite liquid droplet is suppressed. Since the through hole which allows only the satellite liquid droplet to pass through, is formed in the shielding body, even when the space in which the satellite liquid droplet flies is covered by the shielding body, the satellite liquid droplet which is jetted from the nozzle passes through the through hole and lands assuredly on the recording medium.

In the liquid droplet jetting apparatus of the present invention, an inner wall of the shielding body which defines the through hole may be formed of an electroconductive material, and the inner wall may be kept at an electric potential same as an electric potential of the satellite liquid droplet which is jetted from the nozzle. In this case, when the satellite liquid droplet jetted from the nozzle passes through the through hole, an electrostatic force does not act between the satellite liquid droplet and the inner wall defining the through hole. Consequently, the flying trajectory of the satellite liquid droplet is not changed, and the rectilinearity of flying of the satellite liquid droplet is maintained.

In the liquid droplet jetting apparatus of the present invention, the flying trajectory setting mechanism may set the flying trajectory of the satellite liquid droplet and the flying trajectory of the main liquid droplet to be mutually different. In this case, it is possible to trap easily only the main liquid droplet by the main liquid droplet trapping section.

In the liquid droplet jetting apparatus of the present invention, the through hole may be formed in the shielding body at an area which is in proximity of the main liquid droplet trapping section; and a projection which prevents main liquid droplet, trapped by the main liquid droplet trapping section, from flowing into the through hole may be formed in shielding body at an area between the through hole and the main liquid droplet trapping section. In this case, since the main liquid droplet which is trapped by the main liquid droplet trapping section is shielded by the projection and cannot move to the through hole, it is possible to prevent assuredly the main liquid droplet from flowing into the through hole.

In the liquid droplet jetting apparatus of the present invention, a highly liquid-repellent area having a liquid repellent property higher than a liquid repellent property of the main liquid droplet trapping section may be formed in the shielding body at an area between the though hole and the main liquid droplet trapping section. In this case, since the main liquid droplet trapped by the main liquid droplet trapping section cannot cross over the highly liquid repellent area and move to the through hole, it is possible to prevent assuredly the main liquid droplet from flowing into the through hole.

In the liquid droplet jetting apparatus of the present invention, an area dimension of the highly liquid-repellent area may be narrowed toward the main liquid droplet trapping section. In this case, when a part of the main liquid droplet is adhered to the highly liquid repellent area, this main liquid droplet is moved toward the main liquid droplet trapping section for which an area of the highly liquid repellent area is small and an area of a low liquid repellent property is big. Therefore, the main liquid droplet is prevented assuredly from flowing into the through hole.

In the liquid droplet jetting apparatus of the present invention, the liquid repellent property of the highly liquid-repellent area may be decreased toward the main liquid droplet trapping section. In this case, when a part of the main liquid droplet is adhered to the highly liquid repellent area, this main liquid droplet is moved toward the main liquid droplet trapping area having an inferior liquid repellent property. Therefore, it is possible to prevent assuredly the main liquid droplet from flowing into the through hole.

In the liquid droplet jetting apparatus of the present invention, the flying trajectory setting mechanism may set the flying trajectory of the satellite liquid droplet and the flying trajectory of the main liquid droplet to be same; and a front end portion of the main liquid droplet trapping section may be arranged in an area, of the space which partially overlaps with the main liquid droplet as viewed from an axial direction of the nozzle and which does not overlap with the satellite liquid droplet as viewed from the axial direction. In this case, since only the main liquid droplet is trapped by the main liquid droplet trapping section, it is not necessary to let the flying trajectory of the main liquid droplet and the flying trajectory of the satellite liquid droplet to be different, and a mechanism of the liquid droplet jetting apparatus becomes simple.

The liquid droplet jetting apparatus of the present invention, may further comprise a liquid channel which communicates with the nozzle, and a recovery channel which communicates with the liquid channel, and which returns the trapped main liquid droplet back to the liquid channel may be formed in the main liquid droplet trapping section. In this case, it is possible to reuse without discarding, the main liquid droplet which is trapped by the main liquid droplet trapping section, and to reduce a consumption of the liquid.

According to a second aspect of the present invention, there is provided a liquid droplet jetting apparatus which jets, onto an object, a main liquid droplet, and a satellite liquid droplet which has a volume smaller than a volume of the main liquid droplet, includes a nozzle;

a flying trajectory setting mechanism which sets a flying trajectory of the main liquid droplet jetted from the nozzle, and a flying trajectory of the satellite liquid droplet jetted from the nozzle, a flying rectilinearity maintaining mechanism which maintains a rectilinearity of the satellite liquid droplet flying from the nozzle toward the object; and a main liquid droplet trapping section which traps only the main liquid droplet, and which is arranged at a position at which the main liquid droplet trapping section makes contact with the main liquid droplet jetted from the nozzle and has no contact with the satellite liquid droplet.

According to the second aspect of the present invention, since the rectilinearity of the satellite liquid droplet is maintained by the flying rectilinearity maintaining mechanism, it is possible to suppress declining of an accuracy of a landing position of the satellite liquid droplet on the object (recording medium) due to a change in the flying trajectory of the satellite liquid droplet.

According to a third aspect of the present invention, there is provided a liquid droplet jetting apparatus which jets, onto an object, a main liquid droplet, and a satellite liquid droplet which has a volume smaller than a volume of the main liquid droplet, which includes a nozzle;

a liquid channel which communicates with the nozzle;

a shield which shields a space in which the satellite liquid droplet jetted from the nozzle flies; and a trap which traps only the main liquid droplets, and which is arranged in the space at a position at which the trap makes contact with the main liquid droplet jetted from the nozzle, and has no contact with the satellite liquid droplet. A hole through which only the satellite liquid droplet is passable is formed in the shield.

According to the third object of the present invention, the hole which allows only the satellite liquid droplet to pass through, is provided in the shield which shields the space between the nozzle and the object (recording medium), in which the satellite liquid droplet jetted from the nozzle flies. Therefore, it is possible to allow only the satellite liquid droplet land on the recording medium, and to form a very small dot on the recording medium.

DETAILED DESCRIPTION OF THE PREFERRED EMBODIMENTS

An embodiment of the present invention will be described below. This embodiment is an example in which the present invention is applied to an ink-jet printer which includes an ink-jet head which jets ink from a nozzle, on to a recording paper (object, recording medium), as a liquid droplet jetting apparatus.

Figure 1:
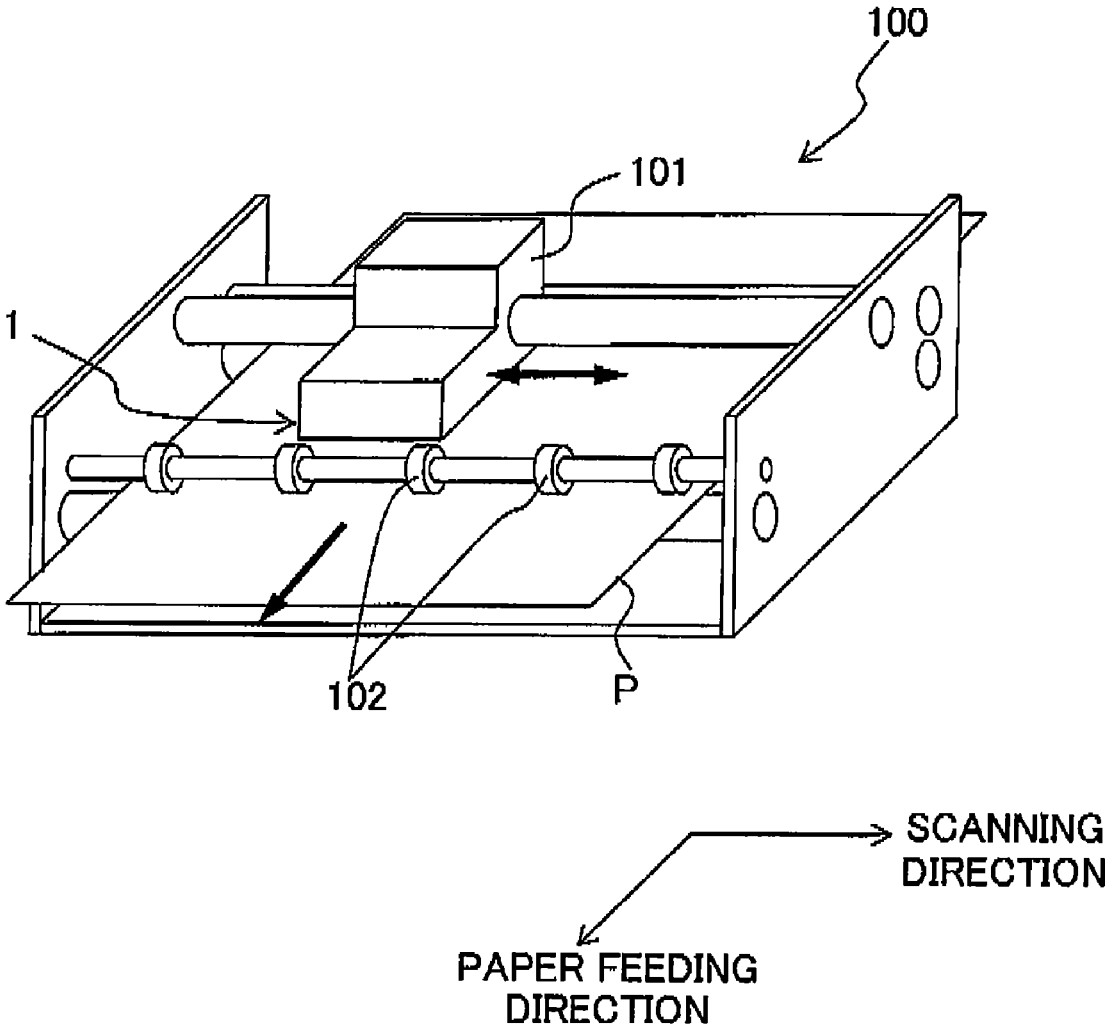
FIG. 1 is a schematic structural diagram of an ink-jet printer according to an embodiment of the present invention.

Firstly, an ink-jet printer 100 will be described below. As shown in FIG. 1, the ink-jet printer 100 includes a carriage 101 which is movable in a scanning direction (left and right direction in FIG. 1), an ink-jet head 1 of a serial type which is provided on the carriage 101 and discharges ink on to a recording paper P, and transporting rollers 102 which carry the recording paper P in a paper feeding direction (forward direction in FIG. 1). The ink-jet head 1 moves integrally with the carriage 101, and jets ink on to the recording paper P from ejecting ports 24 of a nozzle 20 (refer to FIG. 2 to FIG. 6) formed in a lower surface of the carriage 101. The recording paper P with an image recorded thereon by the ink-jet head 1, is discharged in the paper feeding direction by the transporting rollers 102.

Next, the ink-jet head 1 will be described below. As shown in FIG. 2 to FIG. 5, the ink-jet head 1 includes a channel unit 2 in which ink channels including the nozzle 20 and a pressure chamber 14 are formed, and a piezoelectric actuator 3 which is arranged on an upper surface of the channel unit 2, and applies a jetting pressure on ink in the pressure chamber 14.

Figure 3:
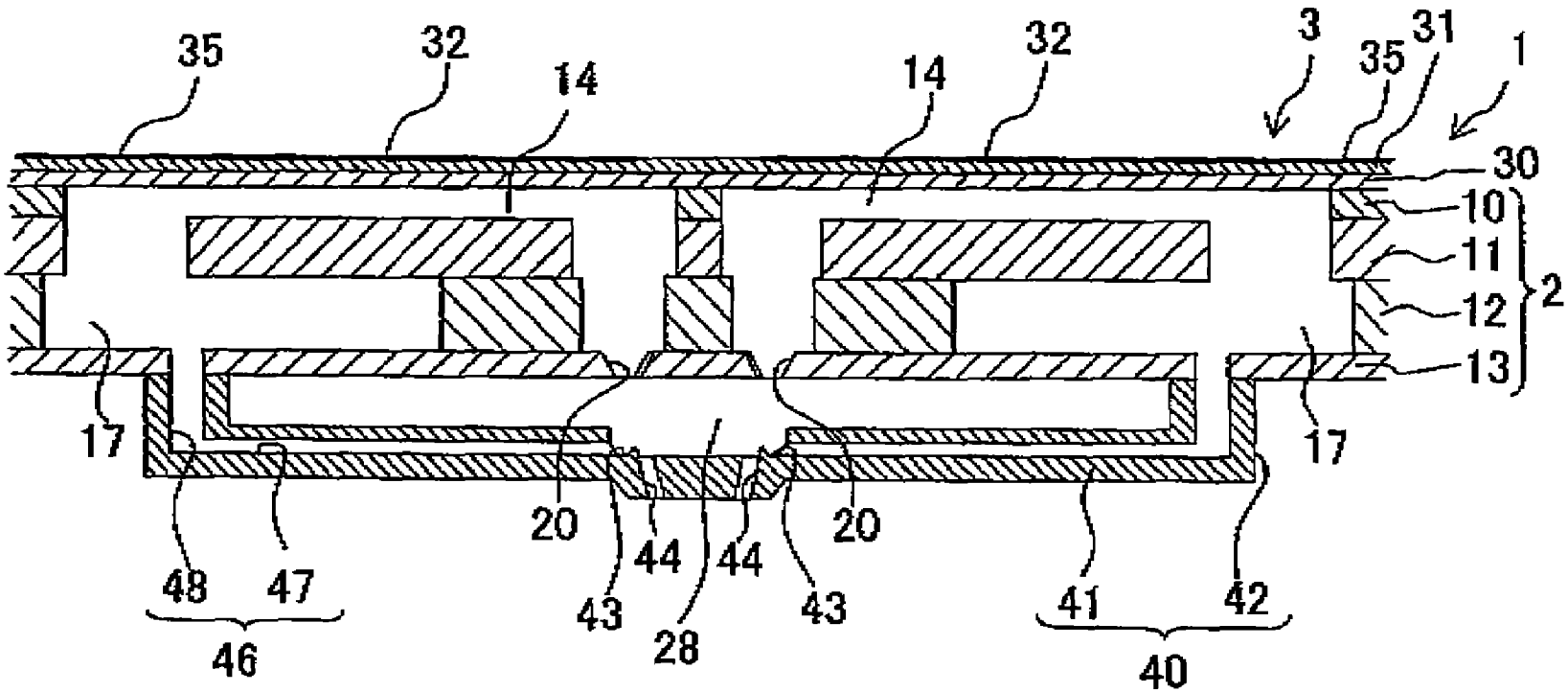
FIG. 3 is across-sectional view taken along a line III-III in FIG. 2.
Figure 4:
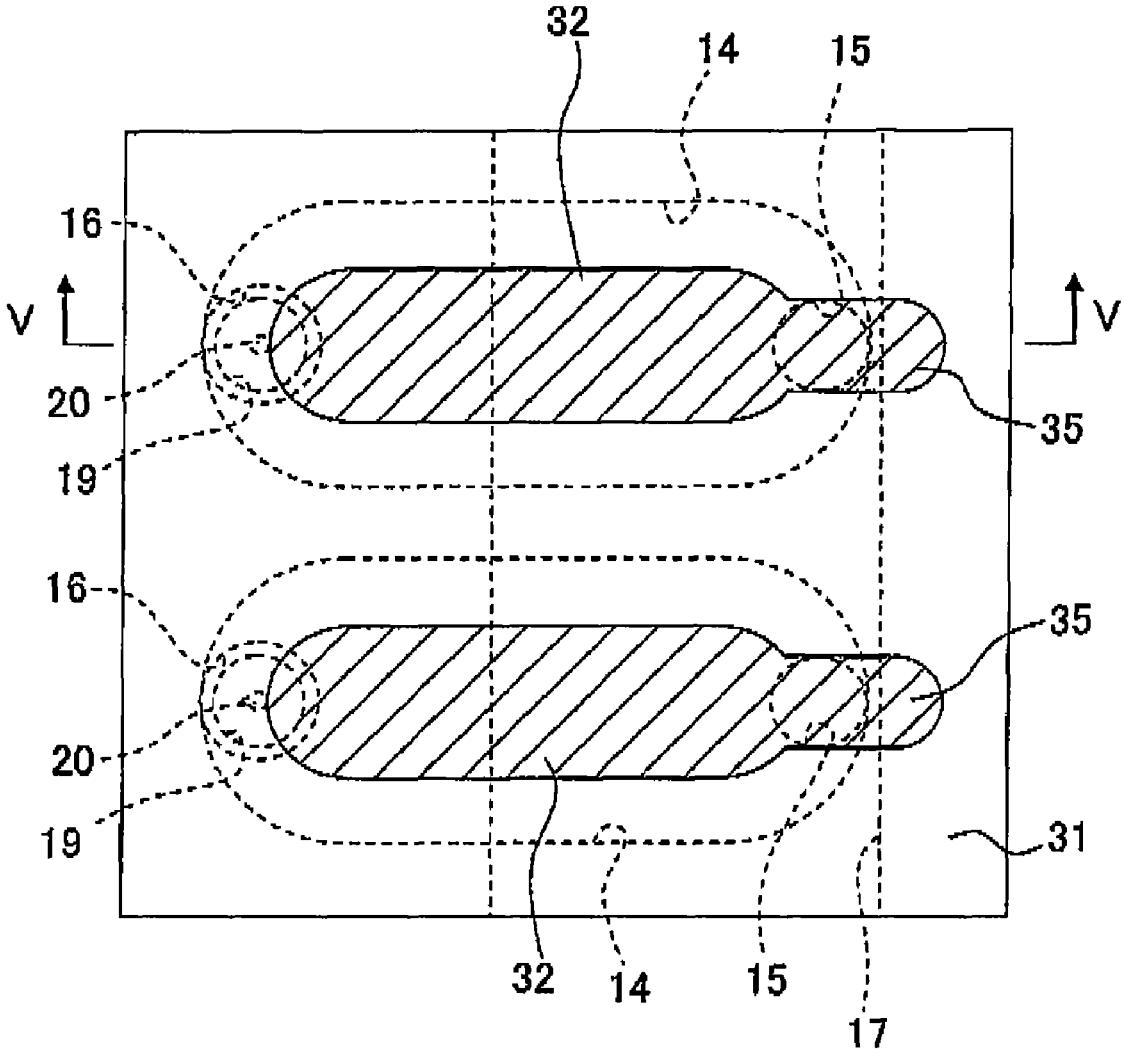
FIG. 4 is a partially enlarged view of FIG. 2.

Firstly, the channel unit 2 will be described below. As shown in FIG. 3, the channel unit 2 includes a cavity plate 10, a base plate 11, a manifold plate 12 and a nozzle plate 13, and these four 10 to 13 are joined in stacked layers. Moreover, each of these four plates 10 to 13 is a plate made of stainless steel. It is possible to form easily a manifold 17 which will be described later, and the ink channels including the pressure chamber 14 and the nozzle 20 in these four plates 10 to 13 by a method such as an etching and a press working (stamping).

As shown in FIG. 2 to FIG. 5, in the cavity plate 10, a plurality of pressure chambers arranged along a plane is formed as through holes. These pressure chambers 14 are covered from both an upper and a lower side by a vibration plate 30 and the base plate 1 respectively. Each of the pressure chambers 14 is formed to be substantially elliptical in a plan view, and is arranged such that a longitudinal axis of the elliptical shape is in the scanning direction. Furthermore, the pressure chambers 14 are arranged in two rows in the paper feeding direction (vertical direction in FIG. 2).

Figure 2:
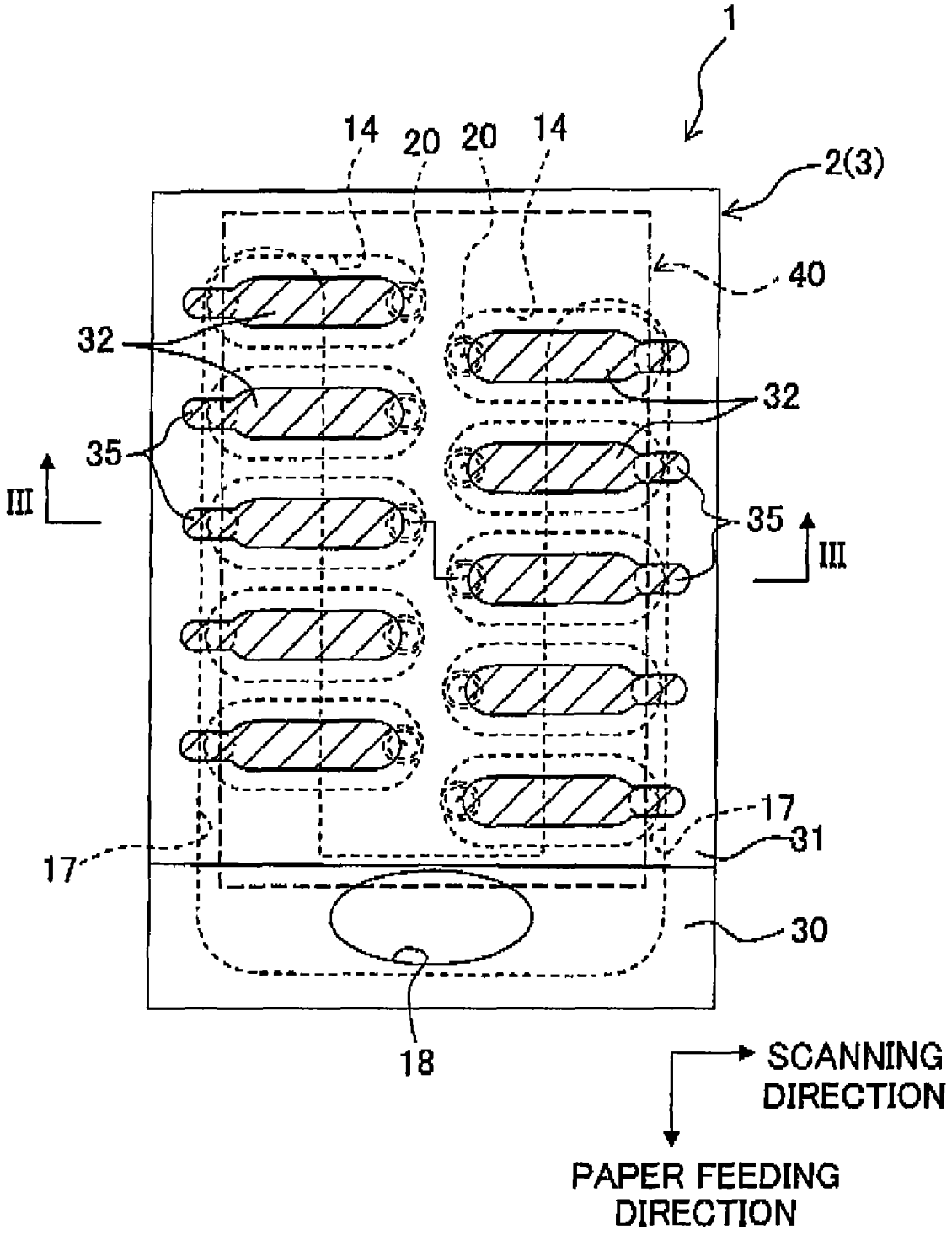
FIG. 2 is plan view of an ink-jet head.

Communicating holes 15 and 16 are formed in the base plate 1, at positions overlapping with both end portions of the pressure chamber 14 in a plan view. Moreover, the manifold 17 which extends in the paper feeding direction is formed in the manifold plate 12. Moreover, as shown in FIG. 2, the manifold 17 is arranged so as to overlap with a left half portion of the pressure chambers 14 which are arranged on a left side and a right half portion of the pressure chambers 14 which are arranged on a right side, in a plan view. Furthermore, the manifold 17 communicates with an ink supply port 18 which is formed in the vibration plate 30 which will be described later. Ink is supplied to the manifold 17 from an ink tank (omitted in the diagram) via the ink supply port 18. Moreover, communication holes 19 communicating with the communicating holes 16 are formed in the manifold plate 12, at positions overlapping with end portions of the pressure chambers 14 on a side opposite to the manifold 17, in a plan view.

Figure 6A:
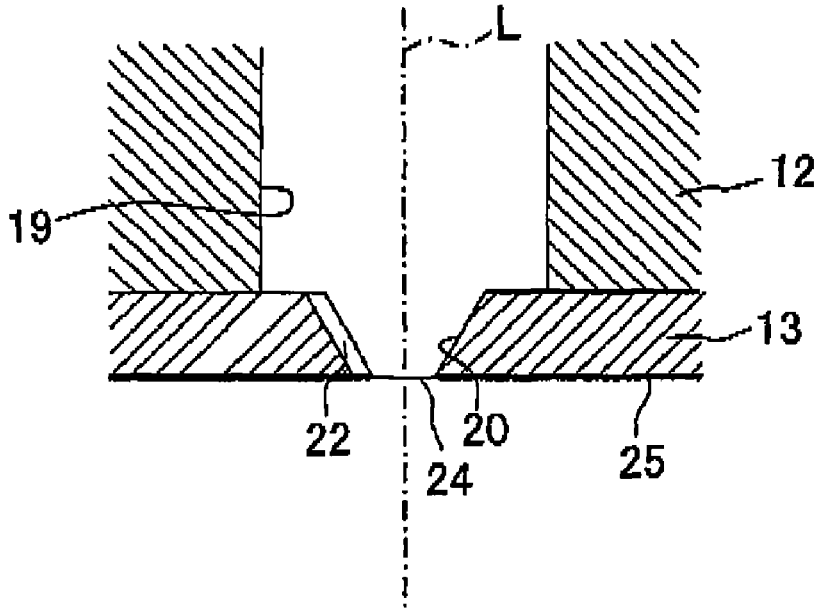
FIG. 6A is an enlarged view of an area around a nozzle of FIG. 5.

Furthermore, a plurality of nozzles 20 is formed in the nozzle plate 13, at positions overlapping with the communicating holes 19 in a plan view. As shown in FIG. 2, the nozzles 20 overlap with the end portions of the pressure chambers 14 arranged in two rows, on the side opposite to the manifold 17, and are arranged in two rows with a pitch of the same interval in the paper feeding direction, at a substantially central portion in a left and right direction of the ink-jet head 1. As shown in FIG. 6A, a liquid repellent film 25 which prevents the ink jetted from the nozzle 20 from adhering to an area near the ejecting port 24, is formed on an entire lower surface of the nozzle plate 13 in which the ejecting port 24 of the nozzle 20 is formed.

Figure 5:
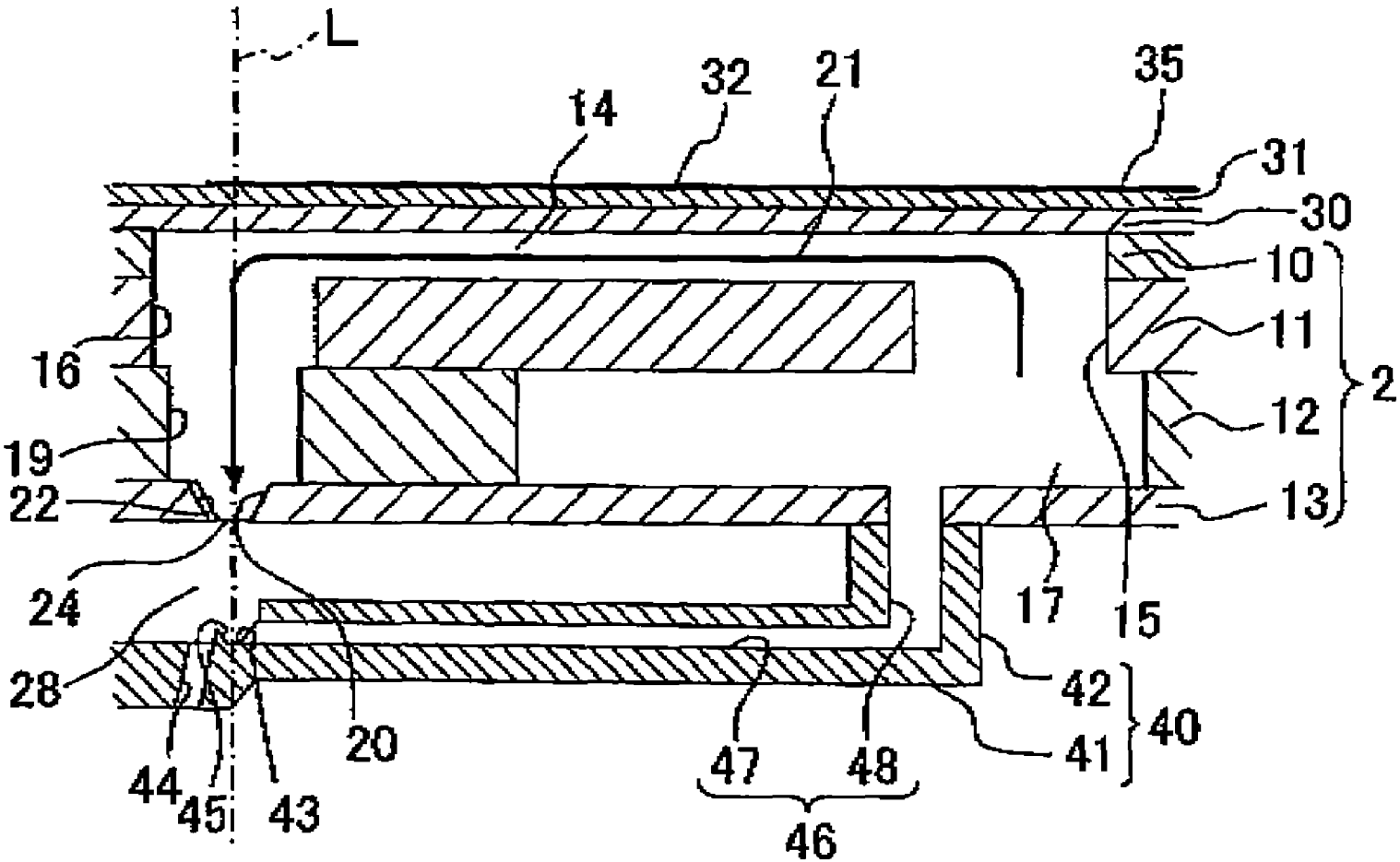
FIG. 5 is a cross-sectional view taken along a line IV-IV in FIG. 4.

As shown in FIG. 5, the manifold 17 communicates with the pressure chambers 14 via the communicating holes 15, and the pressure chambers 14 communicates with the nozzles 20 via the communicating holes 16 and 19. Thus, a plurality of individual ink channels 21 from the manifold 17 up to the nozzles 20 via the pressure chambers 14 is formed in the channel unit 2.

Figure 6B:
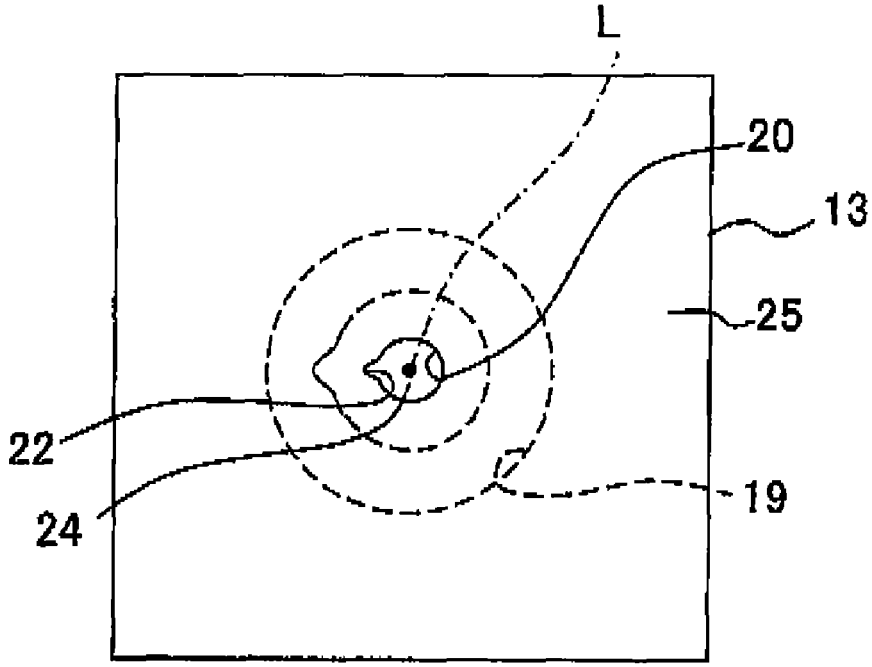
FIG. 6B is an enlarged view of the area around the nozzle as viewed from the lower side.

Here, as shown in FIG. 5, FIG. 6A, and FIG. 6B, each of the nozzles 20 is formed to have a substantially circular horizontal cross-section, and a taper shaped vertical cross-section. An axis L of each of the nozzles 20 is parallel with respect to a vertical direction. Moreover, in an inner wall of each of the nozzles 20, a notch 22 of which a direction of depth is an outer side of a radial direction (left side in FIG. 6A and FIG. 6B) of each of the nozzles 20, and which is extended from the ejecting port 24 at a lower end of one of the nozzles 20, up to an upper end of one of the nozzles 20 is formed. In other words, as shown in FIG. 6B, a portion of the ejecting port 24 of each of the nozzles 20 is formed to be extended from a circular edge, toward the outer side of the radial direction (left side in FIG. 6B), going away from the axis L of one of the nozzles 20. Each of the nozzles 20 is capable of jetting a main liquid droplet which has a comparatively bigger volume, and also jetting a satellite liquid droplet which has a comparatively smaller volume than the volume of the main liquid droplet, along with the main liquid droplet. In other words, when the main liquid droplet is jetted from one of the nozzles 20, along the axis L of the nozzle 20, a rear end portion of the main liquid droplet is pulled by the notch 22, and is separated from the main liquid droplet. This separated portion becomes the satellite liquid droplet having the volume smaller than the volume of the main liquid droplet, and is flown along the direction in which the notch is extended, in other words in a direction inclined by a predetermined angle with respect to the axis L (refer to FIG. 10), such that the satellite liquid droplet is going away from the axis L. In other words, a trajectory of flying of the satellite liquid droplet differs from a trajectory of flying of the main liquid droplet. Thus, since the flying trajectory of the main liquid droplet is different from the flying trajectory of the satellite liquid droplet, as it will be described later, it is possible to realize easily a trapping of only the main liquid droplet and making only the satellite liquid droplet to land on the recording paper P. The nozzle 20 having the notch 22 corresponds to a flying trajectory setting mechanism used in the present invention.

Next, the piezoelectric actuator 3 will be described below. As shown in FIG. 2 to FIG. 5, the piezoelectric actuator 3 includes a vibration plate 30 which is arranged on an upper surface of the channel unit 2, a piezoelectric layer 31 which is formed continuously over the pressure chambers 14, on an upper surface of the vibration plate 30, and a plurality of individual electrodes 32 which are formed corresponding to the pressure chambers 14 respectively, on an upper surface of the piezoelectric layer 31.

The vibration plate 30 is an electroconductive metallic plate having a substantially rectangular shape in a plan view, and is made of a material such as an iron alloy like stainless steel, a copper alloy, a nickel alloy, or a titanium alloy. This vibration plate 30 is arranged on an upper surface of the cavity plate 10 to cover the pressure chambers 14, and is joined to the upper surface of the cavity plate 10. Moreover, the vibration plate 30 is kept at a ground electric potential all the time, and also serves as a common electrode with respect to the individual electrodes 32, which generates an electric field in the piezoelectric layer 31 between the individual electrode 32 and the vibration plate 30, in a direction of thickness of the piezoelectric layer 31.

The piezoelectric layer 31 which is composed of mainly lead zirconate titanate (PZT) which is a solid solution of lead titanate and lead zirconate, and is a ferroelectric substance, is formed on a surface of the vibration plate 30. This piezoelectric layer 31 is formed continuously over the pressure chambers 14. The piezoelectric layer 31 can be formed by an aerosol deposition (AD method) for example, in which ultra fine particle material is deposited by allowing to collide at a high speed. Apart from the AD method, a sol-gel method, a sputtering method, a hydrothermal synthesis method, or a chemical vapor deposition (CVD method) can also be used. Furthermore, the piezoelectric layer 31 can also be formed by sticking on the surface of the vibration plate 30, a piezoelectric sheet which is obtained by baking a green sheet of PZT.

The individual electrodes 32 which are slightly smaller than the pressure chambers 14, and are substantially elliptical shaped are formed on the upper surface of the piezoelectric layer 31, corresponding to the pressure chambers 14 respectively. Each of the individual electrodes 32 is formed at a position overlapping with a central position of the corresponding pressure chamber 14, in a plan view. Moreover, the individual electrodes 32 are made of an electroconductive material such as gold, copper, silver, palladium, platinum, and titanium. A plurality of contact point portions 35 is drawn from one end portion (end portion on a side of the manifold 17) of the individual electrodes 32, in a major axis direction of the individual electrodes 32. Contact points of a flexible wiring member (omitted in the diagram) such as a Flexible Printed Circuit (FPC), are connected to these contact point portions 35. The individual electrodes 32 are electrically connected to a driving circuit (omitted in the diagram) which selectively supplies a drive voltage to the individual electrodes 32, via the wiring member. The individual electrodes 32 and the contact point portions 35 can be formed by a method such as a screen printing, the sputtering method, or a vapor deposition.

Next, an action of the piezoelectric actuator 3 at the time of ink jetting will be described below. When the drive voltage is selectively applied from the driving circuit to the individual electrodes 32, an electric potential of a certain individual electrode 32 on an upper side of the piezoelectric layer 31 to which the drive voltage is applied differs from an electric potential of the common electrode (vibration plate 30) on a lower side of the piezoelectric layer 31, which is kept at the ground electric potential. At this time, the electric field in the direction of thickness of the piezoelectric layer 31 is generated in the piezoelectric layer 31 which is sandwiched between the certain individual electrode 32 and the vibration plate 30. Here, when a direction in which the piezoelectric layer 31 is polarized and the direction of the electric field are the same, the piezoelectric layer 31 is elongated in the direction of thickness which is a direction in which the piezoelectric layer 31 is polarized, and is contracted in a horizontal direction. Next, with a deformation due to the contraction of the piezoelectric layer 31, the vibration plate 30 is deformed to form a projection toward the pressure chamber 14. Therefore, a volume inside the pressure chamber 14 is decreased, so that a pressure is applied to the ink in the pressure chamber 14, and a liquid droplet of ink are jetted from the nozzle 20 which communicates with the pressure chamber 14.

As it has been described above, the nozzle 20 jets the main liquid droplet having the large volume as well as the satellite liquid droplet having the volume smaller than the volume of the main liquid droplet. However, for forming a high quality image on the recording paper P, a structure which traps the main liquid droplet having the big volume is necessary between the nozzle 20 and the recording paper P for making only the satellite liquid droplet having the smaller volume land on the recording paper P.

Moreover, when a flow of air is generated in a space 28 in which the satellite liquid droplet flies, between the lower surface of the nozzle plate 13 in which the ejecting port 24 of the nozzles 20 are formed due to a reciprocation operation of the carriage 101 mounted on the ink-jet head 1 (refer to FIG. 1), since the volume (and weight) of the satellite liquid droplet is very small, there is a possibility that the satellite liquid droplet is flowed by the air flows and a flying direction of the satellite liquid droplets is changed. Moreover, when impurities such as dust are dispersed from outside into the space 28 in which the satellite liquid droplet flies, there is a possibility that the flying direction of the satellite liquid droplet is changed due to a collision with the impurities. When the flying direction of the satellite liquid droplet is changed, a position of landing of the liquid droplet on the recording paper P is shifted from the desired position, and a printing quality is declined.

Further, as shown in FIGS. 2, 3, 5, and 7 to 9, a cover member 40 (shielding body, shield) which traps only the main liquid droplet, and defines the space 28 in which the satellite liquid droplet jetted from the nozzle 20 flies, is provided between the recording paper P and the nozzle plate 12 in which the nozzles 20 are formed. The satellite liquid droplet is shielded from a space on an outer side of the space 28 by the cover member 40.

Figure 7:
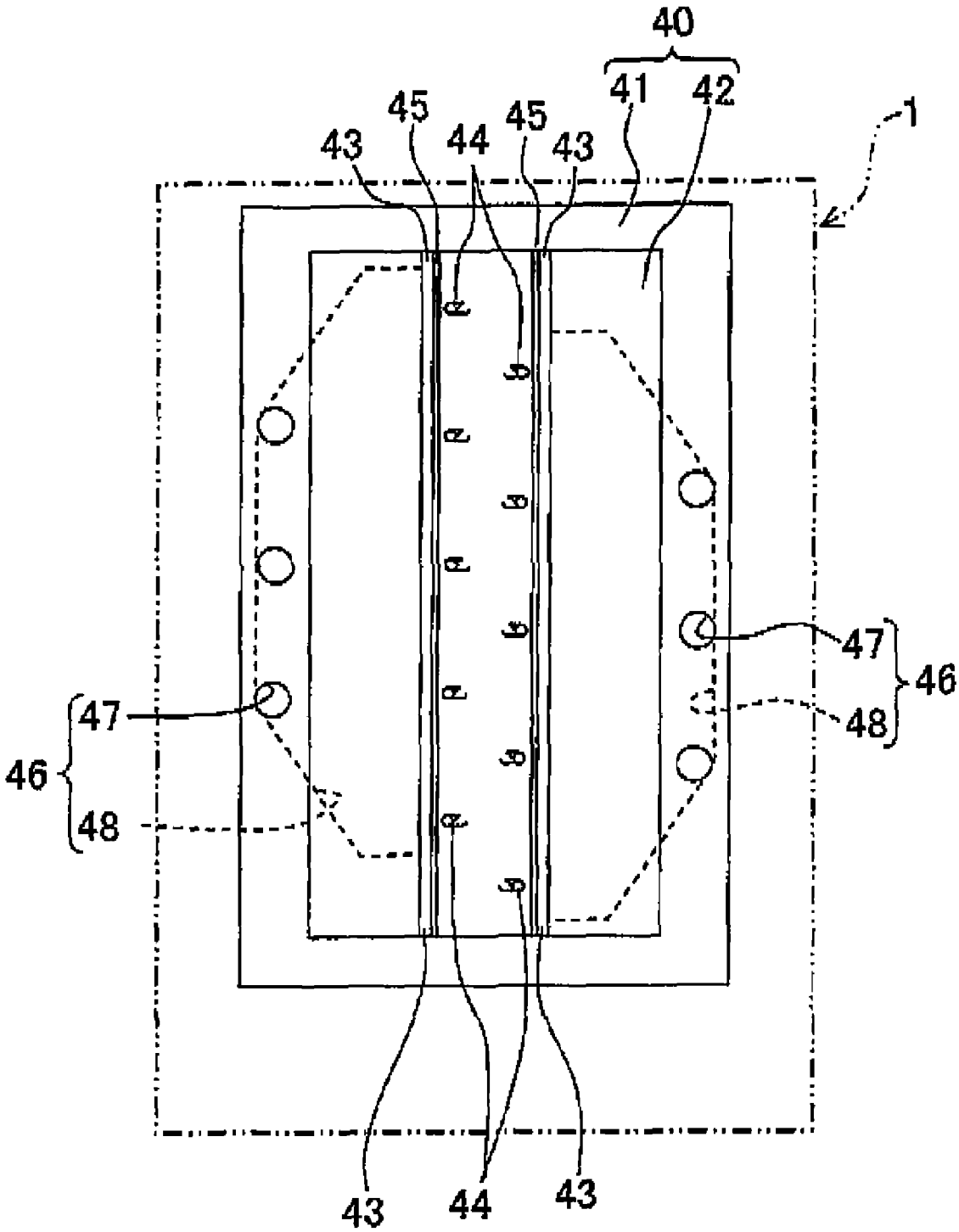
FIG. 7 is a plan view of a cover member.
Figure 8:
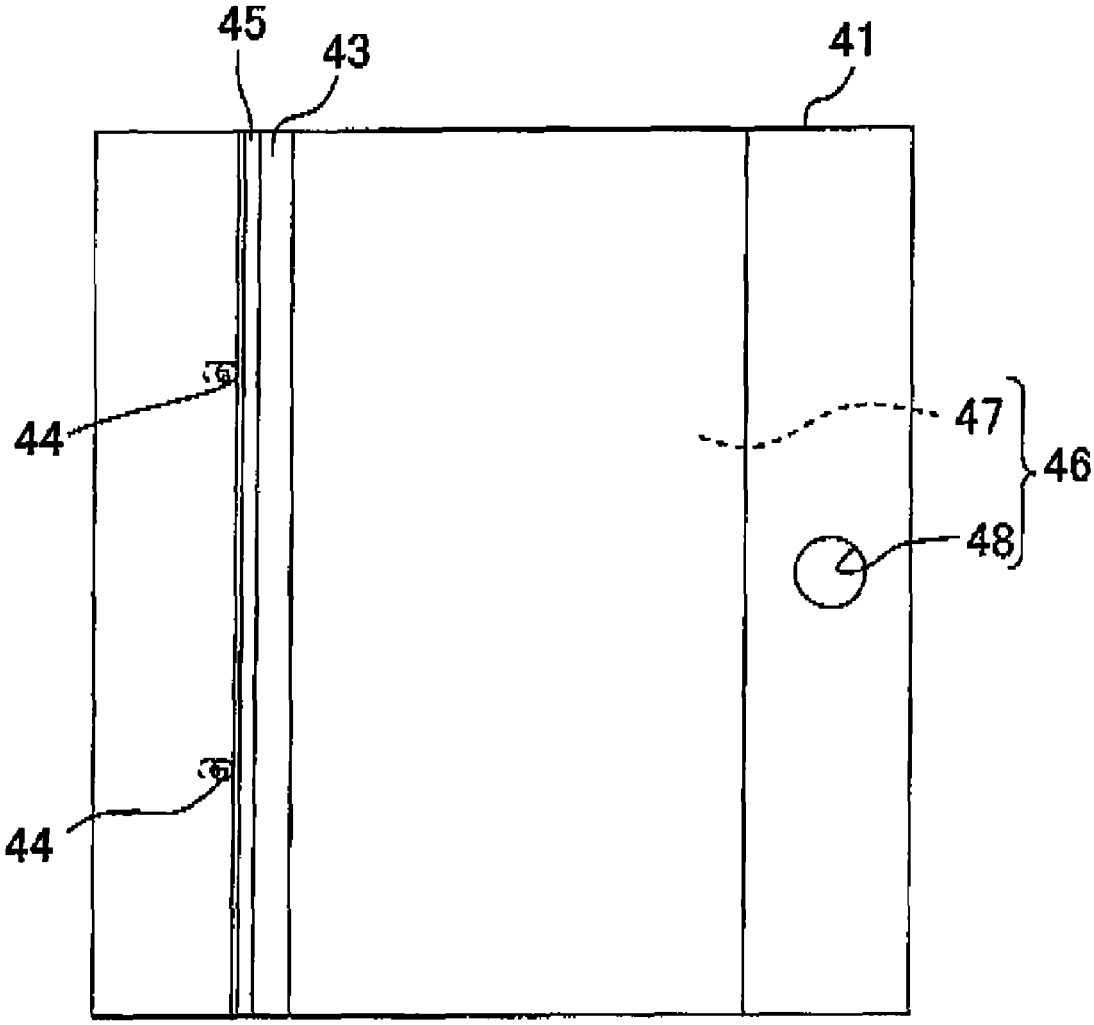
FIG. 8 is a partially enlarged view of FIG. 7.

The cover member 40 is formed of a metallic material in which a bottom wall 41 which covers from a lower side (side of the recording paper P) the space 28 in which the satellite liquid droplet flies, and a side wall 42 which surrounds the space 28 from sides (four sides) are formed integrally. The cover member 40 has a box structure which is rectangular in a plan view. As shown in FIGS. 2, 3 and 7, the side wall 42 is joined to the lower surface of the nozzle plate 13 such that an area in which the two rows of the nozzles 20 are arranged is overlapped within the cover member 40 in a plan view. The channel unit 2 (nozzle plate 13) made of a metallic material and the cover member 40 are joined by an electroconductive adhesive, and the channel unit 2 and the cover member 40 are at the same electric potential. Moreover, the channel unit 2 and the cover member 40 are grounded at a portion which is not shown in the diagram.

As shown in FIGS. 5, and 7 to 9, two flat main liquid droplet trapping sections (two traps) 43 which are extended in a direction in which the nozzles 20 are arranged (paper feeding direction), are formed on an upper surface of the bottom wall 41, at positions facing the two rows of the nozzles 20 respectively. Here, the main liquid droplet trapping section 43 is positioned on the axis L of the nozzles 20 (a dashed line arrow in FIG. 9). Therefore, the main liquid droplet which flies along the axis L of the nozzles 20 comes in contact with the main liquid droplet trapping section 43, but the satellite liquid droplet which flies in the direction inclined by the predetermined angle with respect to the axis L of the nozzles 20 does not come in contact with the main liquid droplet trapping section 43.

Moreover, a plurality of through holes 44 which are in proximity of the main liquid droplet trapping section 43 is formed corresponding to the nozzles 20 respectively, in an area of the bottom wall 41, on an inner side of the two main liquid droplet trapping sections 43. As shown in FIG. 7, these through holes 44 are arranged in two rows along the direction in which the nozzles 20 are arranged, corresponding to the two rows of the nozzles 20 respectively. Each through hole 44 is formed as a through hole pierced through the bottom wall 41 along the flying trajectory of the satellite liquid droplet, at a position on the flying trajectory of the satellite liquid droplet (a continuous line arrow in FIG. 9) along the direction inclined by the predetermined angle with respect to the axis L of the nozzles 20. Furthermore, a projection 45 projected upward is formed parallel to the main liquid droplet trapping section 43, between the rows of the main liquid droplet trapping sections 43 and the through holes 44, of the bottom wall 41, and the main liquid droplet trapping section 43 and an area of the bottom wall 41 in which the through hole 44 is formed are separated by the projection 45.

Figure 10A:
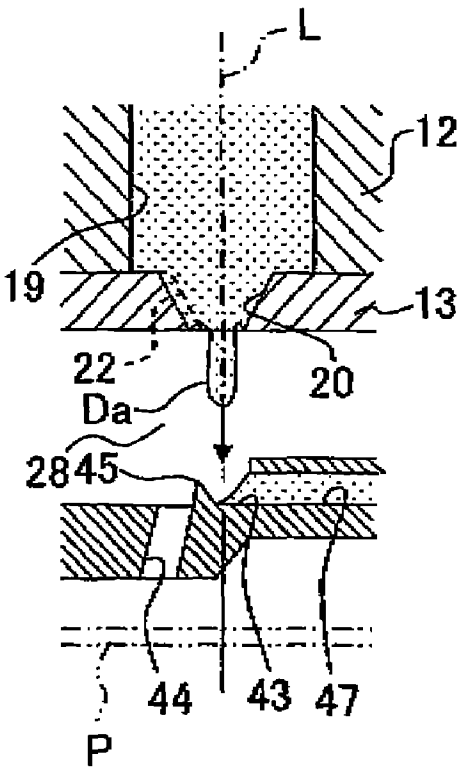
FIG. 10A is a diagram describing an operation of jetting a liquid droplet from the nozzle, in which a state at a time of start of ink jetting is shown.
Figure 10B:
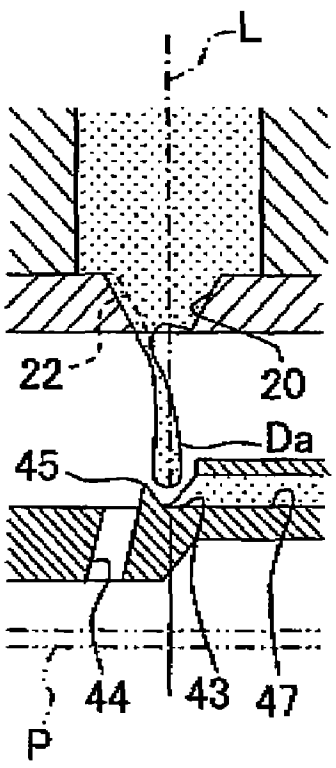
FIG. 10B is a diagram describing the operation of jetting the liquid droplet from the nozzle, in which a state immediately before flying of a satellite liquid droplet is shown.
Figure 10C:
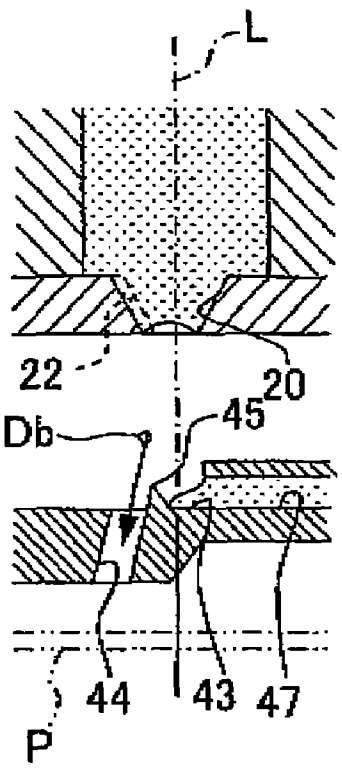
FIG. 10C is a diagram describing the operation of jetting a liquid droplet from the nozzle in which, a state when main liquid droplet is trapped and recovered, is shown.

Further, when the pressure is applied to the ink in the pressure chamber 14 by the piezoelectric actuator 3, as shown in FIG. 10A, firstly, a main liquid droplet Da having a large volume is jetted from one of the nozzles 20 along the axis L of the nozzle 20. Furthermore, as shown in FIG. 10B, a rear end portion (upper end portion) of the main liquid droplet Da which is pulled by the notch 22 is separated from the main liquid droplet Da. Next, as shown in FIG. 10C, this separated portion becomes a satellite liquid droplet Db having a volume smaller than the volume of the main liquid droplet Da, and is flown along the direction in which the notch 22 is extended (along the direction inclined by the predetermined angle with respect to the axis L of the nozzles 20).

Figure 10D:
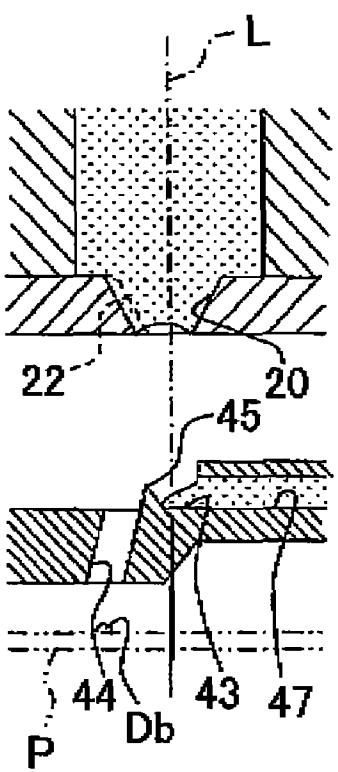
FIG. 10D is a diagram describing the operation of jetting a liquid droplet from the nozzle, in which a state when the satellite liquid droplet is landed on a recording paper is shown.

Here, since the main liquid droplet Dais flown along the axis L, the main liquid droplet Da is trapped by the main liquid droplet trapping section 43 which is positioned on the axis L. Therefore, the main liquid droplet Da is not landed on the recording paper P. On the other hand, the satellite liquid droplet Db is flown toward the direction in which the notch is extended (in the direction inclined by a predetermined angle with respect to the axis L). Consequently, the satellite liquid droplet Db, without coming in contact with the main liquid droplet trapping section 43 on the axis L, reaches the recording paper P upon passing through the through hole 44 formed in proximity of the main liquid droplet trapping section 43, in the direction in which the notch 22 is extended. In other words, as shown in FIG. 10D, only the satellite liquid droplet Db having the small volume is landed on the recording paper P upon passing through one of the through holes 44, and a small dot is formed on the recording paper P. Since the main liquid droplet trapping section 43 and the area of the bottom wall 41 in which the through hole 44 is formed, are separated by the projection 45, the main liquid droplet Da which is trapped by (landed on) the main liquid droplet trapping section 43 is blocked (shielded) by the projection 45, and cannot move into the through holes 44. Therefore, the main liquid droplet Da is prevented assuredly from flowing into the through hole 44.

Figure 9:
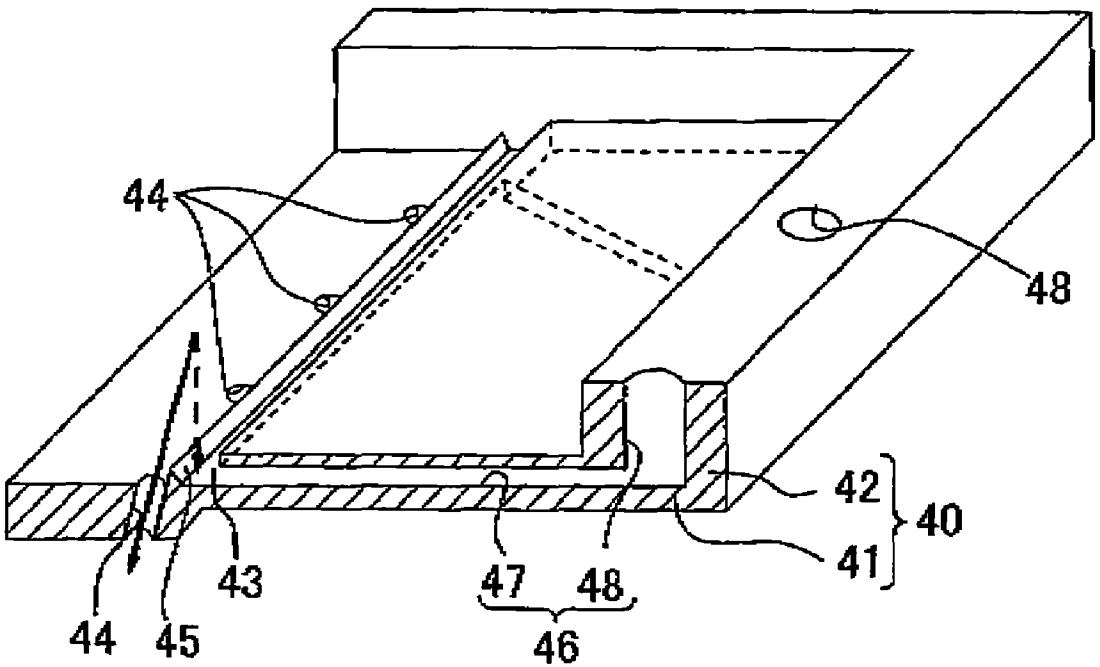
FIG. 9 is a partially enlarged view of the cover member.

Moreover, as shown in FIGS. 3, 5, and 7 to 9, a recovery channel 46 which returns the main liquid droplet trapped by the main liquid droplet trapping section 43 back to an ink channel in the channel unit 2 is formed in the cover member 40. This recovery channel 46 includes a horizontal channel 47 which is formed in the bottom wall 41, and communicates with the main liquid droplet trapping section 43, and a vertical channel 48 which is formed in the side wall 42, and communicates with the horizontal channel 47. As shown in FIGS. 7 and 9, two horizontal channels 47 which are extended from the main liquid droplet trapping section 43 extended in the feeding direction (vertical direction in FIG. 7) up to the side wall 42 positioned at both sides in the scanning direction (left and right direction in FIG. 7), along a horizontal surface (plane) are formed in the bottom wall 41. A channel area of each horizontal channel 47 is narrowed progressively toward the side wall 42. Moreover, three vertical channels 48, which communicate with the horizontal channels 47 respectively, and extended in the vertical direction are formed in the side wall 42 positioned at both sides in the scanning direction. As shown in FIGS. 3 and 5, each of the vertical channels 48 communicates with the manifold 17.

Further, when the main liquid droplet is trapped in the main liquid droplet trapping section 43, the main liquid droplet is drawn in the horizontal channel 47 due to a capillary force, and is returned back to the manifold 17 via the vertical channel 48. Consequently, since it is possible to reuse without discarding, the main liquid droplet trapped by the main liquid droplet trapping section 43, it is possible to reduce a consumption of the ink. A backflow prevention mechanism such as a non-return valve (a check valve) or a pump which prevents the ink from returning to the recovery channel 46 from the manifold 17 may be provided between the manifold 17 and the recovery channel 46 of the cover member 40.

As it has been described above, the cover member 40 shields completely an area between the nozzle plate 13 and the recording paper P, around the space 28 (sides and bottom side of the space 28) in which the satellite liquid droplet flies, except the through holes 44. Therefore, an outflow and an inflow of air between the space 28 and an outside of the space 28 are restricted, and a flow of air hardly occurs inside the space 28. Moreover, dispersion of impurities such as dust from the outside of the space 28 is also suppressed. Consequently, since a rectilinearity of the flying trajectory of the satellite liquid droplet is maintained, a decline in an accuracy of a landing position is suppressed. This cover member 40 corresponds to a flying rectilinearity maintaining mechanism used in the present invention. Furthermore, since the portions which shield the space 28 in which the satellite liquid droplet flies, from the surrounding (the bottom wall 41 and the side wall 42) are formed integrally with the main liquid droplet trapping section 43, the number of components is decreased as compared to the number of components in a case in which the portions shielding the space 28 and the main liquid droplet trapping section 43 are formed separately, and it is possible to reduce a manufacturing cost.

Thus, the channel unit 2 (nozzle plate 13) made of a metallic material and the cover member 40, are joined via an electroconductive adhesive. When the ink to be used is an electroconductive ink such as an ink which has water as a main constituent, the ink in the channel unit 2, and the cover member 40 are at the same electric potential. In other words, since the satellite liquid droplet and an inner wall of the through holes 44 are at the same electric potential, when the satellite liquid droplet passes through one of the through holes 44, an electrostatic force does not act between the satellite liquid droplet and the inner wall of the through hole 44, and the rectilinearity of the flying trajectory of the satellite liquid droplet is maintained assuredly.

Next, modified embodiments in which various modifications are made in the embodiment will be described below. Same reference numerals are assigned to components having a structure similar to the components in the embodiment, and the description of such components is omitted.

First Modified Embodiment

Figure 11:
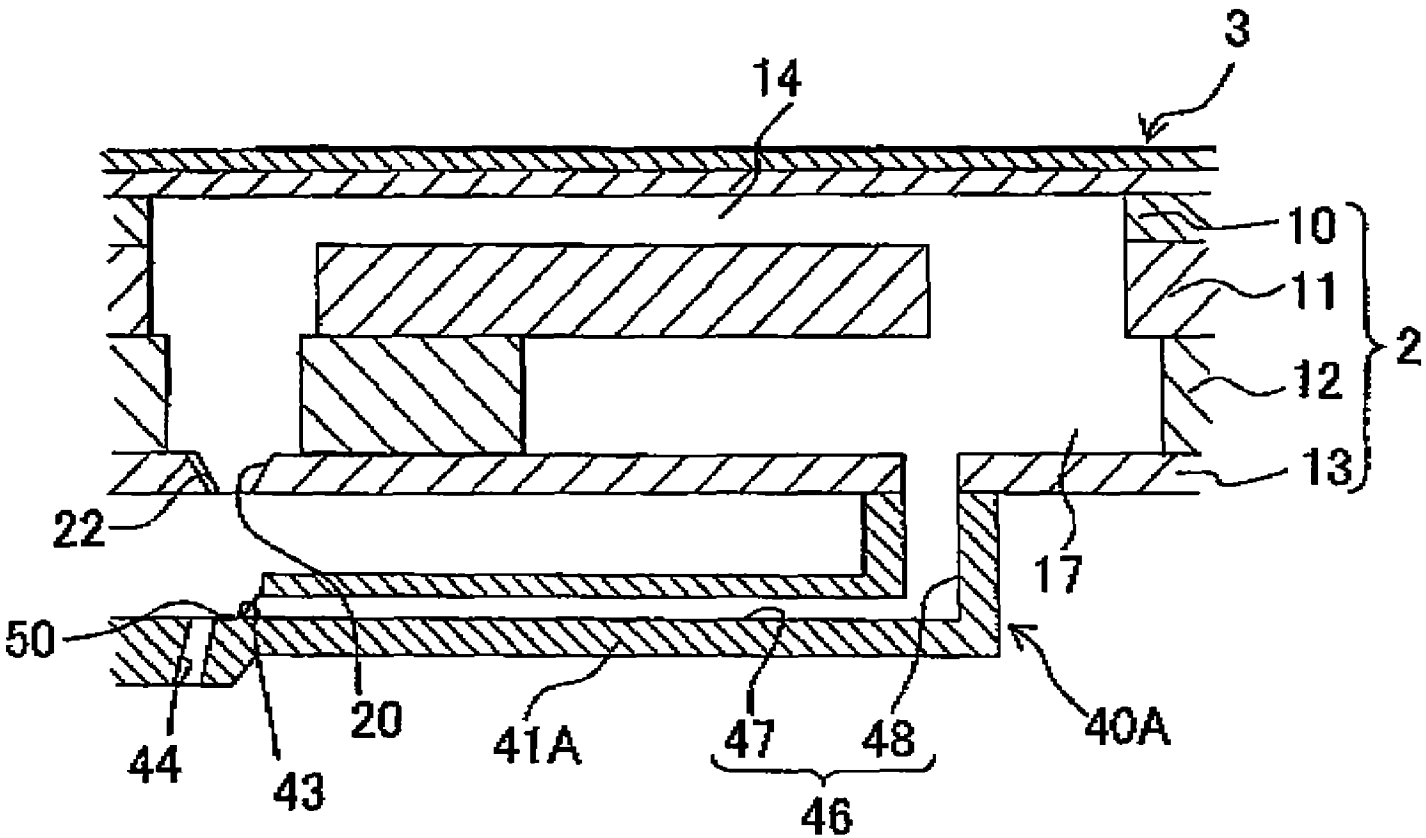
FIG. 11 is a cross-sectional view corresponding to FIG. 5 of an ink-jet head in a first modified embodiment.
Figure 12:
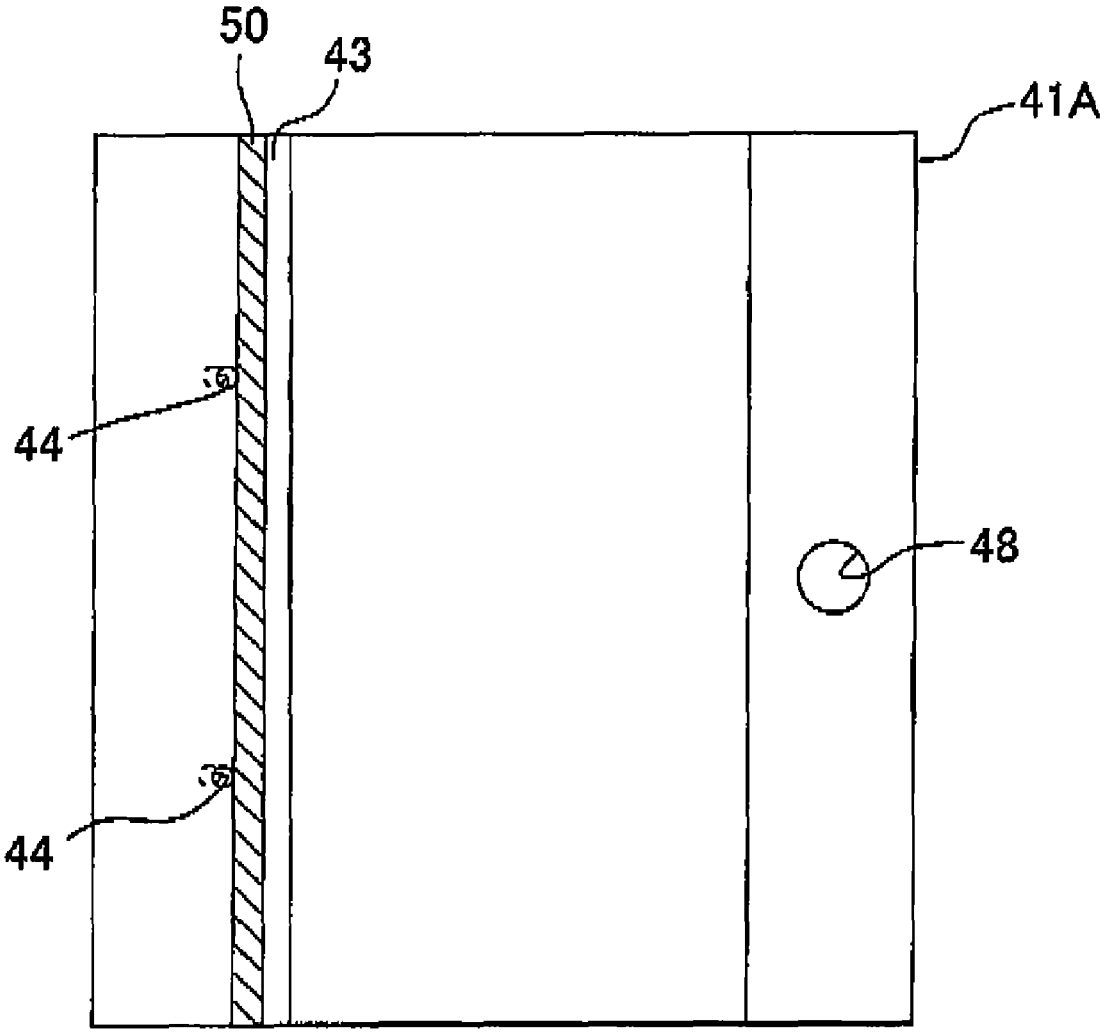
FIG. 12 is a partially enlarged view of a cover member in the first modified embodiment.

In the embodiment described above, the projection 45 is formed between the main liquid droplet trapping section 43 and the through holes 44, with an object of preventing the main liquid droplet trapped by the main liquid droplet trapping section 43, from flowing into the through holes 44 (for example, refer to FIG. 5). However, as shown in FIG. 11 and FIG. 12, instead of the projection 45, a highly liquid repellent area 50 having a liquid repellent property superior to a liquid repellent property of the main liquid droplet trapping section 43 may be formed between the through holes 44 and the main liquid droplet trapping section 43, on an upper surface of a bottom wall 41A of a cover member 40A. Even in this structure, since the main liquid droplet landed on the main liquid droplet trapping section 43 cannot cross over the highly liquid repellent area 50, and move into the through holes 44, the main liquid droplet is prevented assuredly from flowing into the through hole 44.

Second Modified Embodiment

Figure 13:
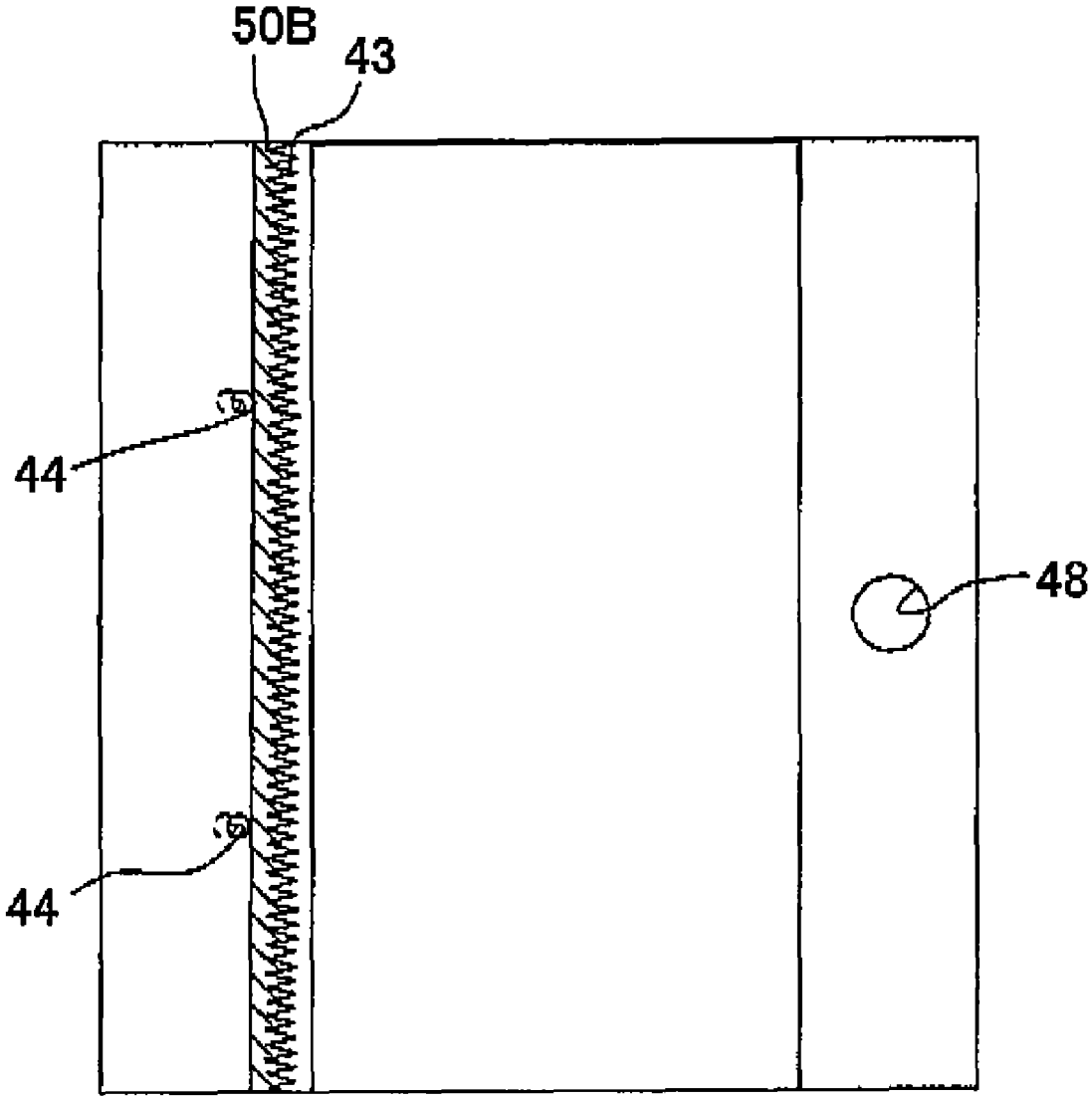
FIG. 13 is a partially enlarged view of a cover member in a second modified embodiment.

Furthermore, in the first modified embodiment, the highly liquid repellent area may be formed such that an area of the highly liquid repellent area is decreased progressively toward the main liquid droplet trapping section, or as shown in FIG. 13, a portion of a highly liquid repellent area 50B toward the main liquid droplet trapping section 43 may be formed to have a zigzag shape having a sharp angular portion, and the area of the highly liquid repellent area 50B may be decreased progressively toward the main liquid droplet trapping section 43.

Third Modified Embodiment

Figure 14:
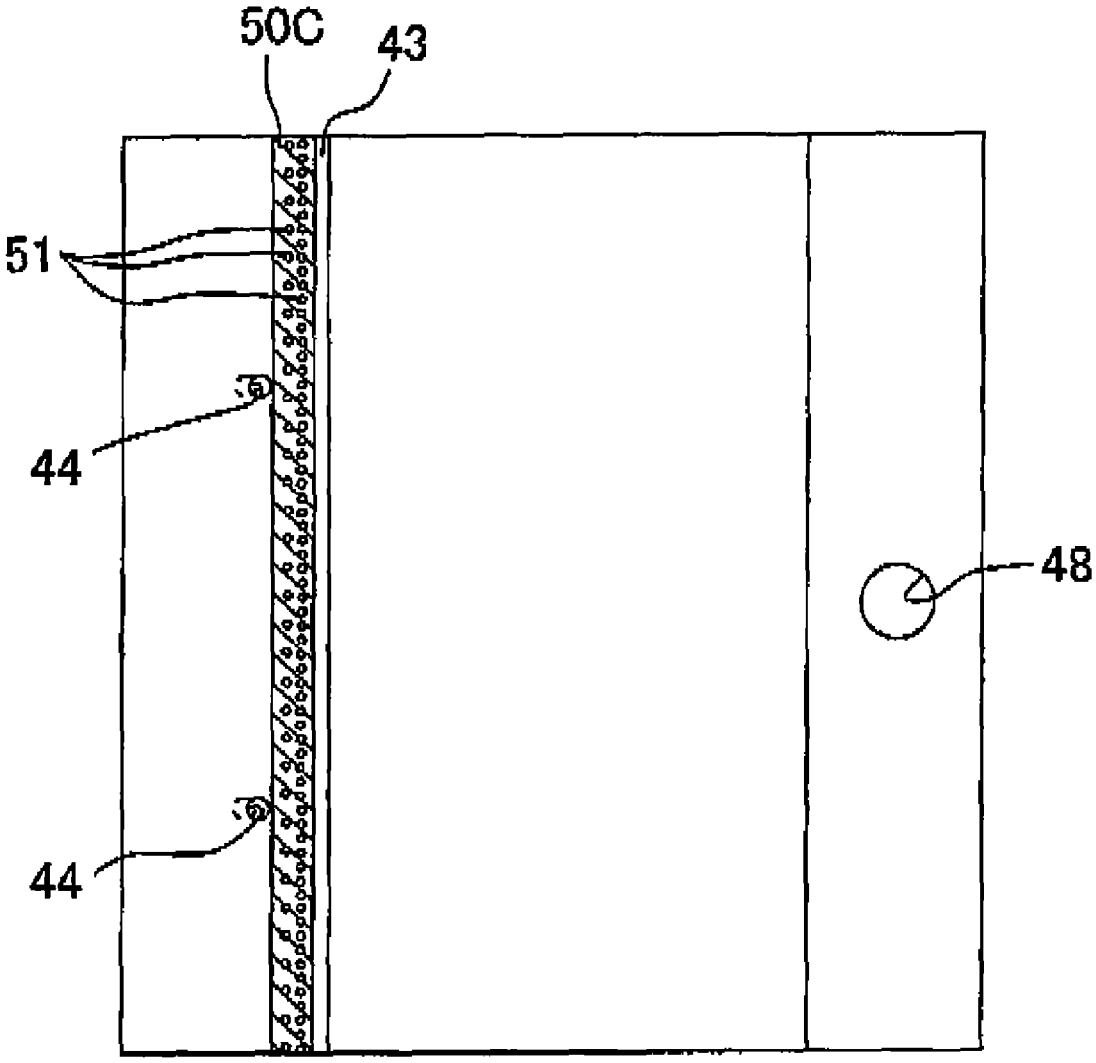
FIG. 14 is a partially enlarged view of a cover member in a third modified embodiment.

The liquid repellent property of the highly liquid repellent area may be low toward the area of the main liquid droplet trapping section. As shown in FIG. 14, a plurality of holes 51 may be formed in a portion of a highly liquid repellent area 50C, on a side of the main liquid droplet trapping section 43, and the holes 51 may be arranged more densely, progressively toward the main liquid droplet trapping section 43, such that the area of the highly liquid repellent area 50C is decreased progressively toward the main liquid droplet trapping section 43.

Fourth Modified Embodiment

Figure 15:
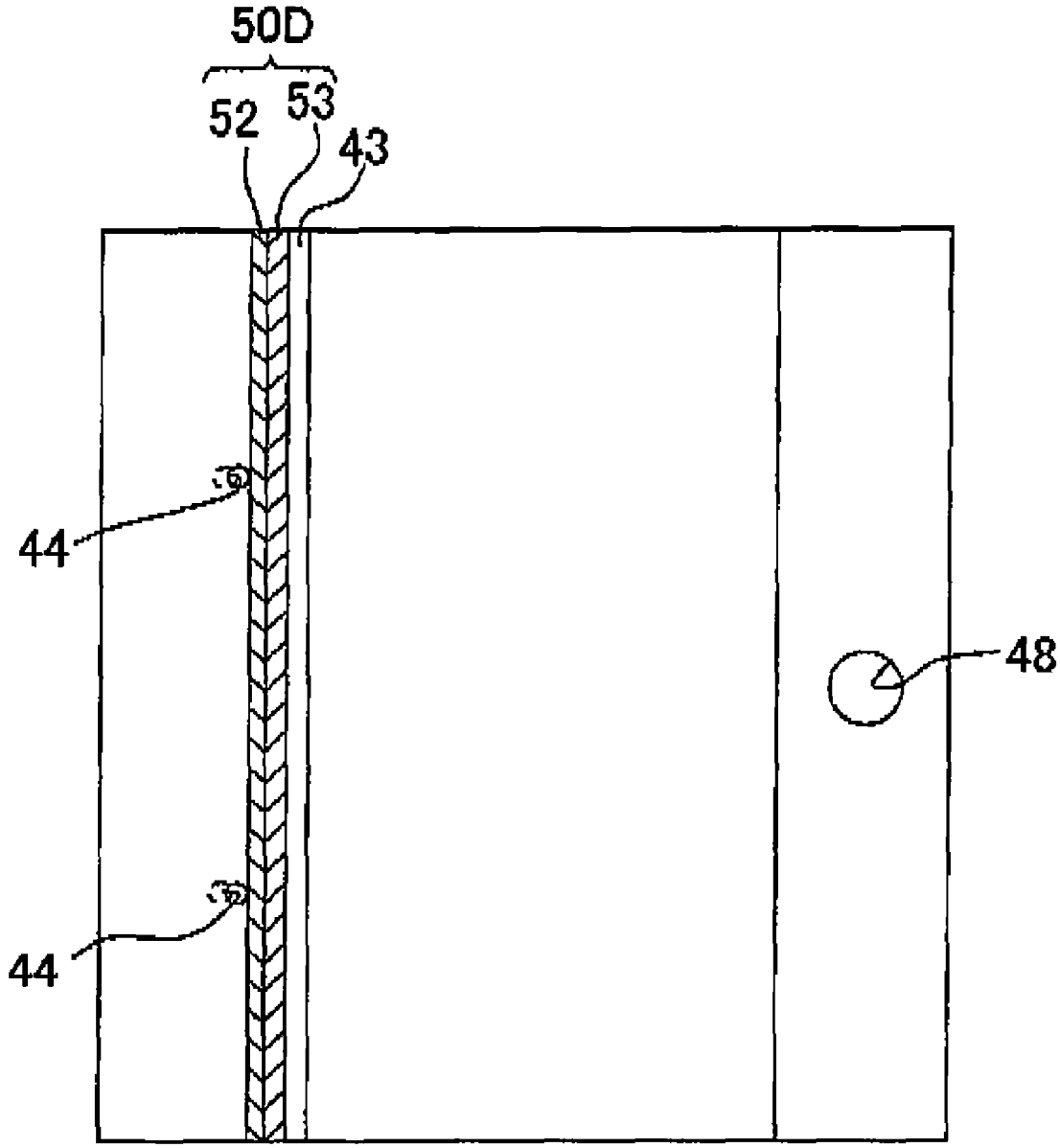
FIG. 15 is a partially enlarged view of a cover member of a fourth modified embodiment.

As shown in FIG. 5, a highly liquid repellent area 50D may include two types of areas (a first highly liquid repellent area 52 and a second highly liquid repellent area 53) arranged adjacent to the scanning direction (left and right direction in FIG. 15), a liquid repellent property of the second highly liquid repellent area 53 which is positioned toward the main liquid droplet trapping section 43 may be inferior to a liquid repellent property of the first highly liquid repellent area 52. According to structures in the second modified embodiment up to the fourth modified embodiment, when a part of the main liquid droplet is adhered to the highly liquid repellent areas 50B, 50C, and 50D when the main liquid droplet is landed on both of the main liquid droplet trapping section 43, and the highly liquid repellent areas 50B, 50C, and 50D, this main liquid droplet is moved toward the main liquid droplet trapping side 43 having an inferior liquid repellent property. Therefore, the main liquid droplet is prevented assuredly from flowing into the through holes 44.

Fifth Modified Embodiment

Figure 16:
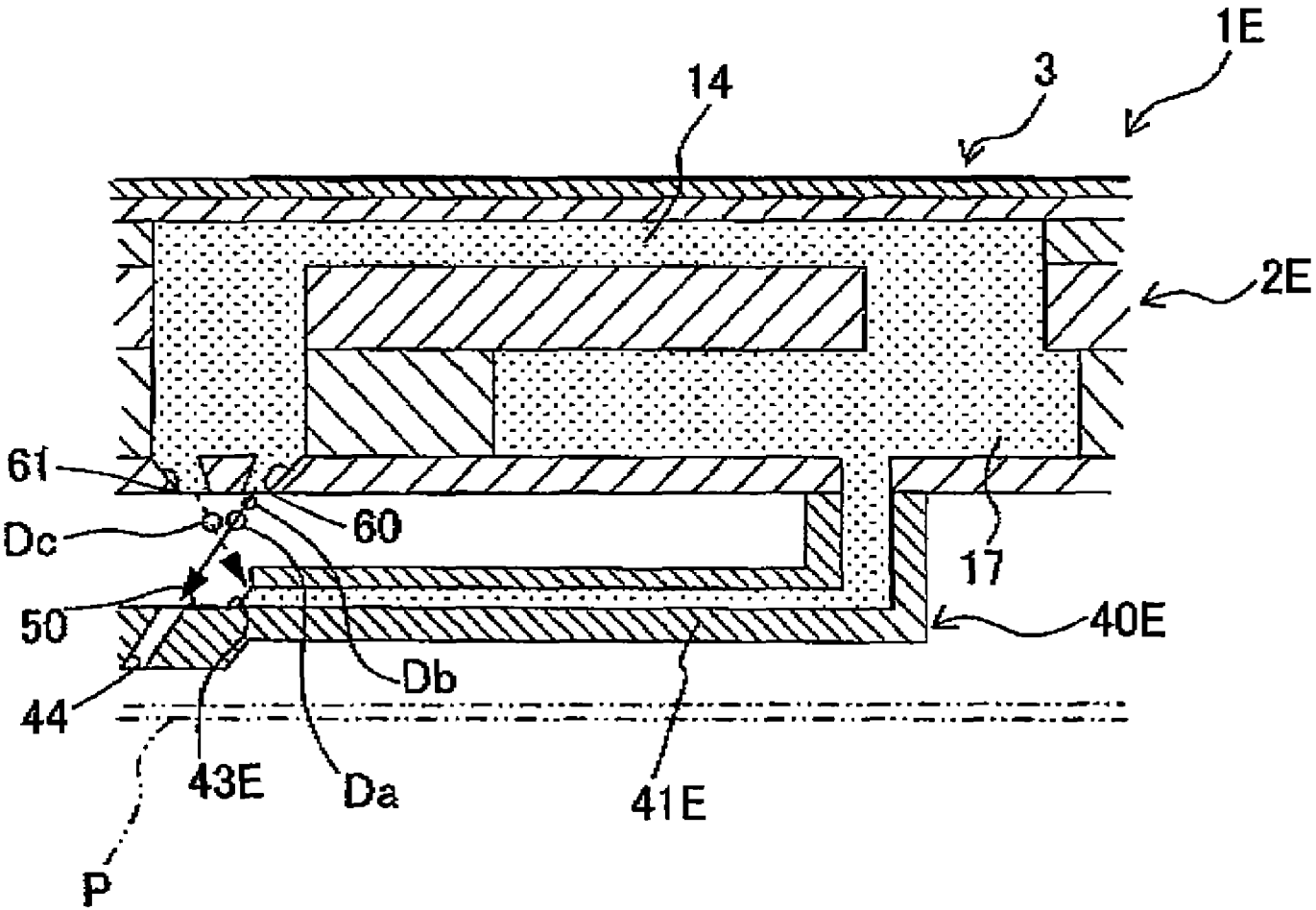
FIG. 16 is a diagram showing an ink-jetting operation of an ink-jet head in a fifth modified embodiment.

An ink-jet head which jets the main liquid droplet and the satellite liquid droplet is not restricted to ink-jet heads having structures in the embodiment and the modified embodiments mentioned above. For example, a channel unit 2E of an ink-jet head 1E in a fifth modified embodiment shown in FIG. 16 includes two nozzles 60 and 61 communicating with one pressure chamber 14. The two nozzles 60 and 61 are arranged in a proximity of the scanning direction (left and right direction in FIG. 16), and axes of these two nozzles 60 and 61 (trajectory of flying of a liquid droplet jetted from the nozzles 60 and 61) intersect mutually. Moreover, a main liquid droplet trapping section 43E which is flat is formed on a bottom wall 41E of a cover member 40E, at a position facing the two nozzles 60 and 61. Furthermore, through holes 44 pierced through the bottom wall 41E along this axis, are formed at positions on the axes of the nozzles 60 (arrow in FIG. 16), of one side in the scanning direction (left side in FIG. 16), of the main liquid droplet trapping section 43E.

An ink jetting action of the ink-jet head 1E in the fifth embodiment will be described below. When the pressure is applied to the ink in the pressure chamber 14 by the piezoelectric actuator 3, a main liquid droplet Da is jetted from the nozzle 60 positioned at a right side in FIG. 16, and further, with the jetting action of this main liquid droplet Da, a satellite liquid droplet Db is also jetted from the nozzle 60. At the same time, a liquid droplet Dc is jetted also from the nozzle 61 positioned at the left side in FIG. 16, and the liquid droplets Da and the liquid droplet Dc jetted from the two nozzles 60 and 61 respectively are collided and combined. When the liquid droplets Da and Dc are combined, a direction of flying of the main liquid droplet Da jetted from the nozzle 60 is changed in a direction of a dashed line arrow, and differs from a direction of flying (continuous line arrow) of the satellite liquid droplet Db. The main liquid droplet Da is landed on the main liquid droplet trapping section 43E of the cover member 40E, and is trapped by the main liquid droplet trapping section 43E. On the other hand, the satellite liquid droplet Db jetted from the nozzle 60 is passed through a through hole 44E upon flying along the axis of the nozzle 60, and does not come in contact with the main liquid droplet trapping section 43E. Consequently, only the satellite liquid droplet Db is landed on the recording paper P, and a small dot is formed on the recording paper P. The two nozzles 60 and 61 which allow the main liquid droplet Da and the satellite liquid droplet Db to fly in different trajectories of flying, correspond to a flying trajectory setting mechanism used in the present invention. Moreover, even in the fifth embodiment, similarly as in the first modified embodiment, the highly liquid repellent area 50 having the liquid repellent property superior to a liquid repellent property of the main liquid droplet trapping section 43E is formed on the bottom wall 41E, between the main liquid droplet trapping section 43E and the through hole 44E, and the main liquid droplet Da trapped by the main liquid droplet trapping section 43E is prevented from flowing into the through holes 44E. In U.S. patent application Ser. No. 7,004,555, an ink-jet head similar to the ink-jet head of the fifth modified embodiment, which makes only the satellite liquid droplet land on a recording medium by combining the main liquid droplets jetted from a plurality of nozzles, and changing a trajectory of flying of the main liquid droplet, is disclosed. Content described in U.S. patent application Ser. No. 7,004,555 is incorporated herein by reference, and let to be a part of a description of this application.

Sixth Embodiment

In the embodiment described above, the flying trajectory of the main liquid droplet and the flying trajectory of the satellite liquid droplet differ mutually. However, even when the flying trajectory of the main liquid droplet and the flying trajectory of the satellite liquid droplet are different, it is possible to trap only the main liquid droplet, and to make only the satellite liquid droplet land on the recording paper P. For example, in an ink-jet head 1F of a sixth embodiment shown in FIG. 17, a horizontal cross-sectional shape of a nozzle 20F is circular, and a vertical cross-sectional shape of the nozzle 20F is tapered. An axis L of the nozzle 20F is extended in a vertical (perpendicular) direction. Therefore, as shown in FIG. 18, both of a main liquid droplet Da and a satellite liquid droplet Db jetted from the nozzle 20F fly in a vertically downward direction.

Figure 17:
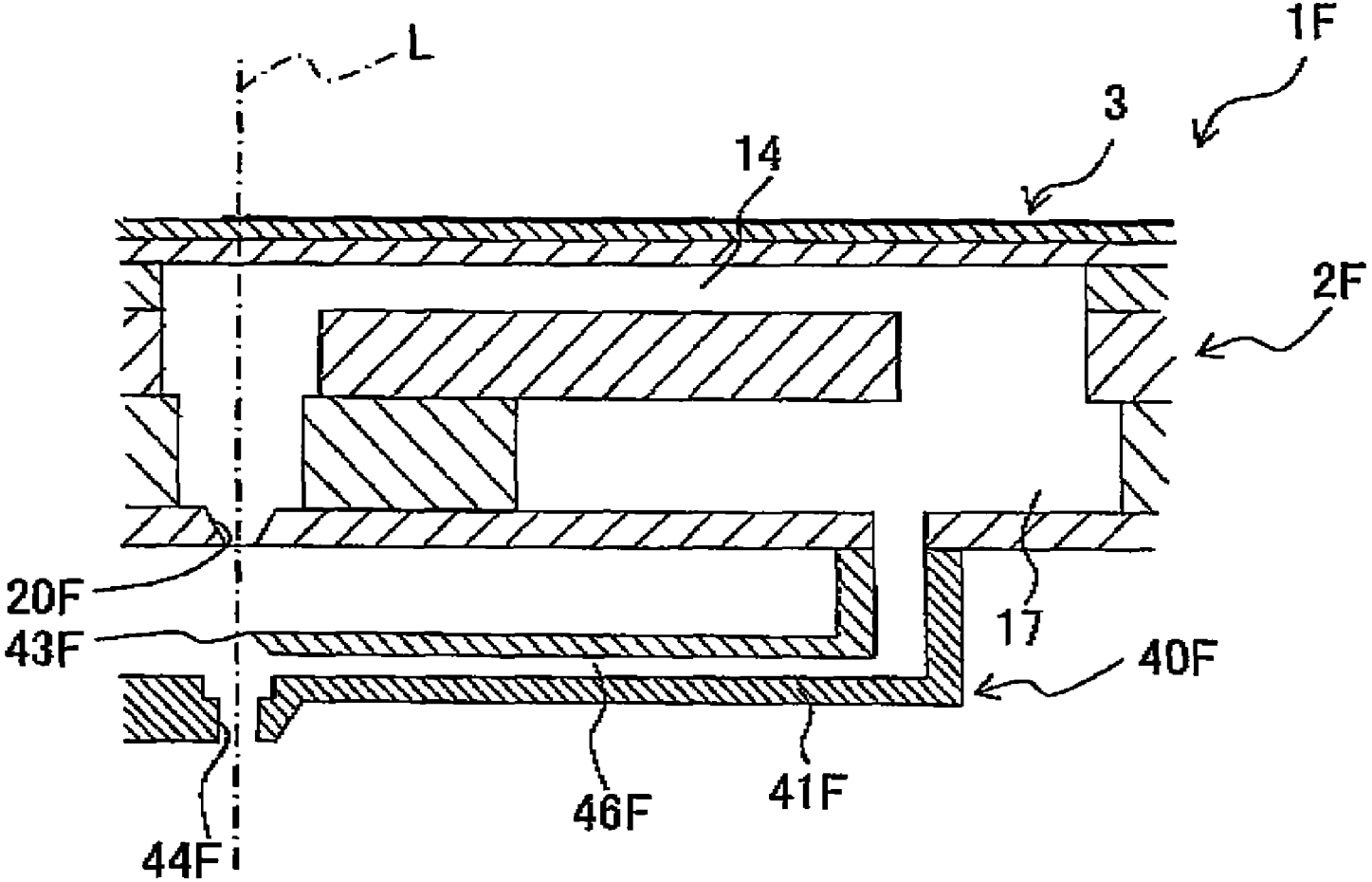
FIG. 17 is a cross-sectional view corresponding to FIG. 5 of an ink-jet head in a sixth modified embodiment.
Figure 18A:
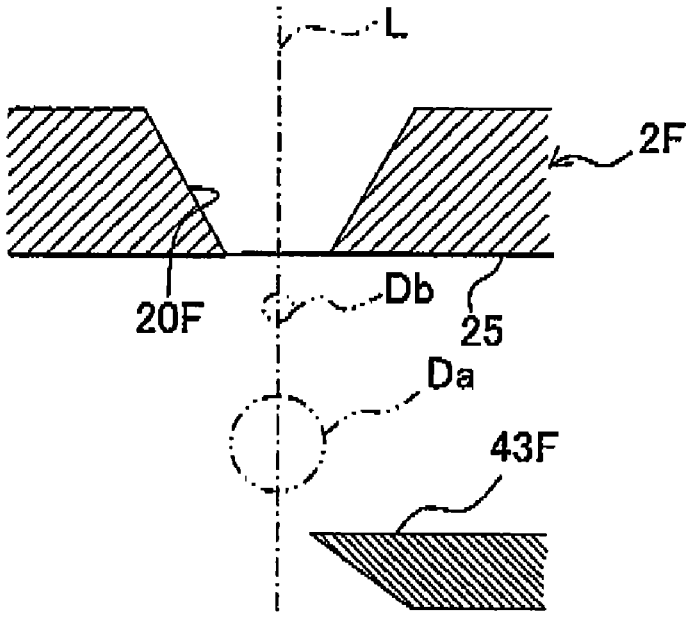
FIG. 18A is a cross-sectional enlarged view of an area around the nozzle.
Figure 18B:
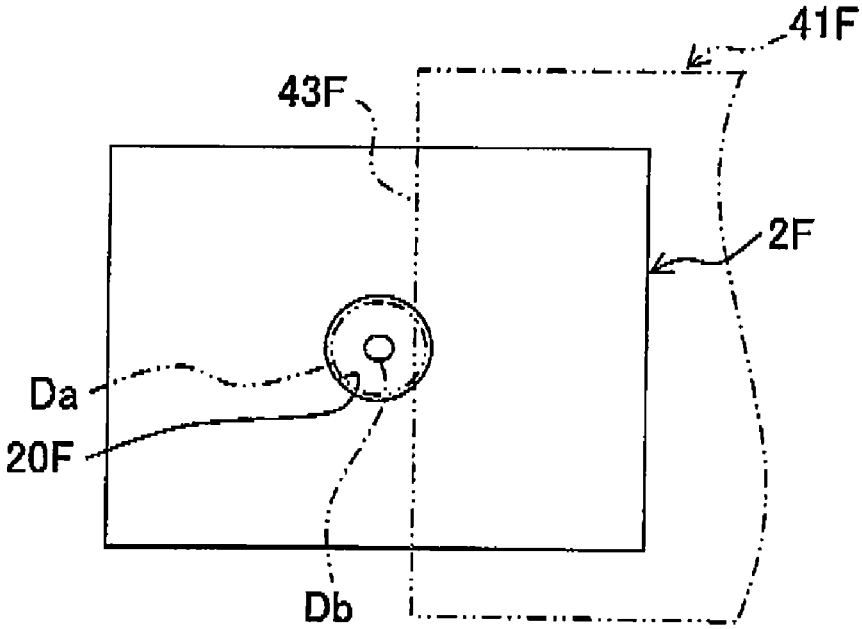
FIG. 18 is an enlarged view of the area around the nozzle when viewed from a lower side.
Figure 19:
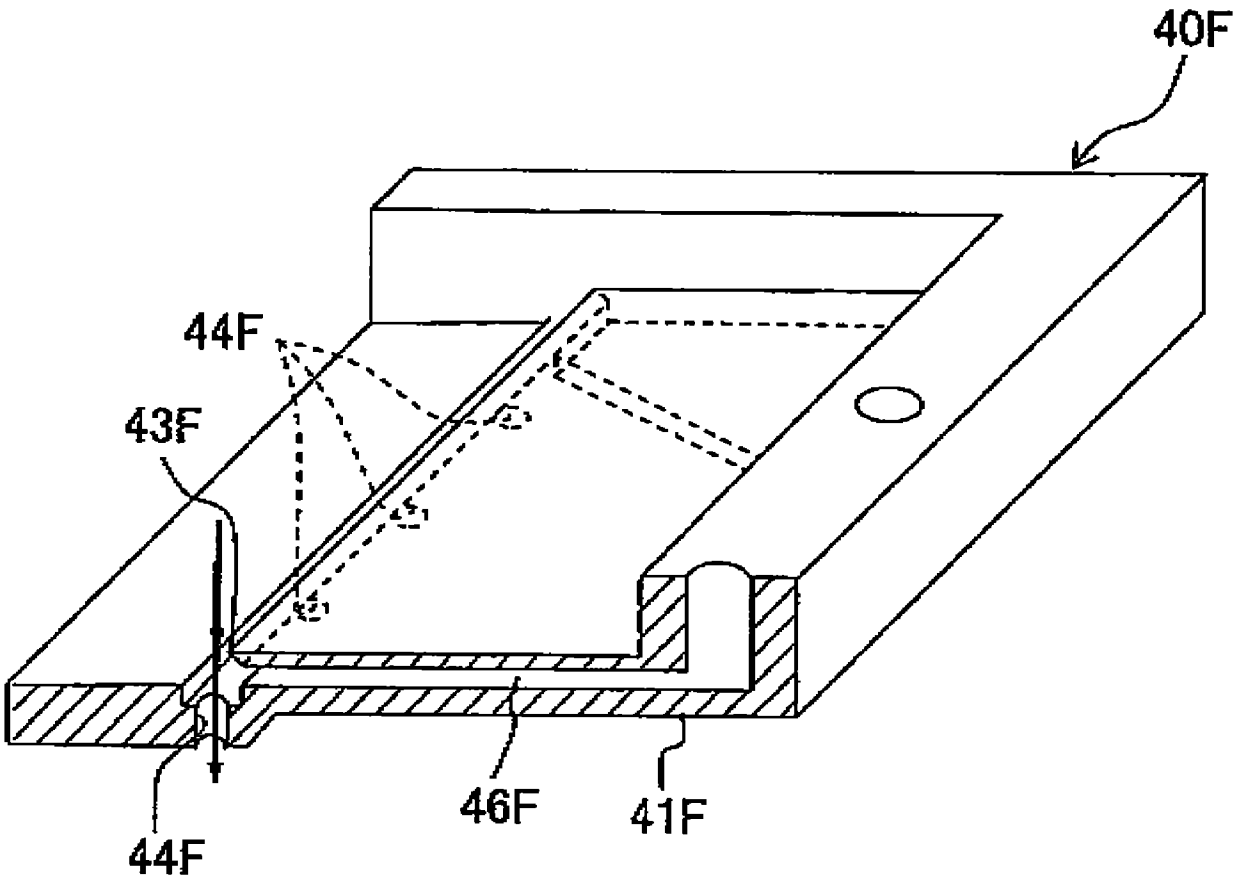
FIG. 19 is a partially enlarged perspective view of a cover member in the sixth embodiment.

As shown in FIGS. 17 to 19, a main liquid droplet trapping section 43F projected horizontally from a right side in FIG. 17 up to an area near the axis L of the nozzle 20F, at a lower side of the nozzle 20F, is provided to a bottom wall 41F of a cover member 40F. A front end portion of the main liquid droplet trapping section 43F is inclined to go away from the axis L of the nozzle 20F, progressively downward which is a direction of flying of the liquid droplet. Furthermore, the main liquid droplet trapping section 43F communicates with a recovery channel 46F which is formed inside the cover member 40F. Moreover, as shown in FIG. 18, when viewed from a direction of the axis L, the front end of the main liquid droplet trapping section 43F is arranged in an area in which the front end of the main liquid droplet trapping section 43F overlaps partially with the main liquid droplet Da which is flown, in a state that a center of the front end of the main liquid droplet trapping section 43F coincides with the axis L of the nozzle 20F, and the front end of the main liquid droplet trapping section 43F does not overlap with the satellite liquid droplet Db which is flown, in a state that the center of the front end of the main liquid droplet trapping section 43 coincides with the axis L of the nozzle 20F. In other words, the main liquid droplet trapping section 43F is arranged at a position at which the main liquid droplet trapping section 43F comes in contact with the main liquid droplet Da, but does not come in contact with the satellite liquid droplet Db. It is possible to realize such an arrangement since the volume of the satellite liquid droplet Db becomes very small as compared to the volume of the main liquid droplet Da (for example, one by several tenths or less), a diameter of the liquid droplet also becomes very small. On the other hand, as shown in FIG. 17, a through hole 44F which is parallel to the axis L is formed in the bottom wall 41F, at a position at a farther left side of the main liquid droplet trapping section 43A, on the axis of the nozzle 20F.

Figure 20A:
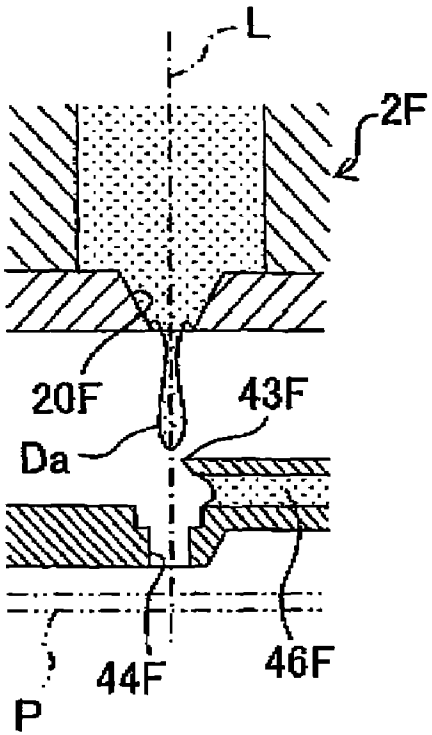
FIG. 20A is a diagram describing the operation of jetting the liquid droplet from the nozzle, in which the state at the time of start of ink jetting is shown.
Figure 20B:
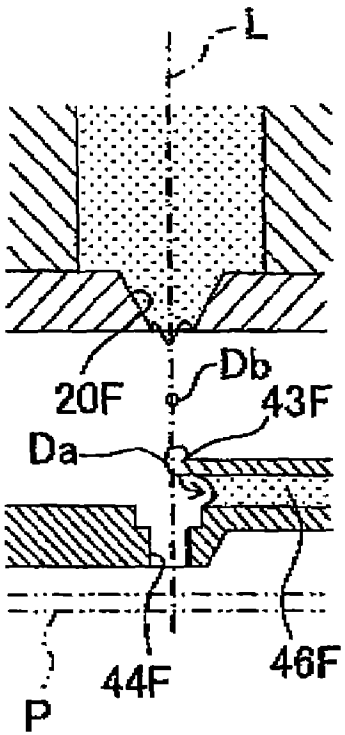
FIG. 20B is a diagram describing the operation of jetting the liquid droplet from the nozzle, in which a state when the main liquid droplet is trapped in the main liquid droplet trapping section is shown.

An ink jetting action of the ink-jet head IF in the sixth embodiment will be described below. When the pressure is applied to the ink in the pressure chamber 14 by the piezoelectric actuator 3, as shown in FIG. 20A, firstly a main liquid droplet Da having a large volume is jetted downward from the nozzle 20F along the axis L of the nozzle 20F. When the main liquid droplet Da is jetted, a rear end portion of the main liquid droplet Dais pulled toward the nozzle 20F, and separated. As shown in FIG. 20B, a separated portion becomes a satellite liquid droplet Db and is flown downward along the axis L of the nozzle 20F, similarly as the main liquid droplet Da.

Figure 20C:
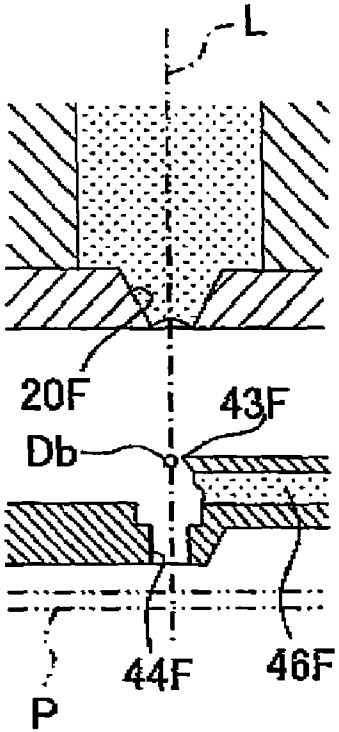
FIG. 20C is a diagram describing the operation of jetting liquid droplets from the nozzle, in which a state when the main liquid droplet is recovered in a recovery channel is shown.

Here, the front end portion of the main liquid droplet trapping section 43F is arranged in an area of the bottom wall 41F in which, the front end portion of the main liquid droplet trapping section 43F overlaps partially with the main liquid droplet Da which flies along the axis L of the nozzle 20P, but does not overlap with the satellite liquid droplet Db which flies along the axis L of the nozzle 20F. Therefore, as shown in FIG. 20B, the main liquid droplet Da having a large diameter is trapped by the front end portion of the main liquid droplet trapping section 43F, but as shown in FIG. 20C, the satellite liquid droplet Db having a small diameter is not trapped.

Figure 20D:
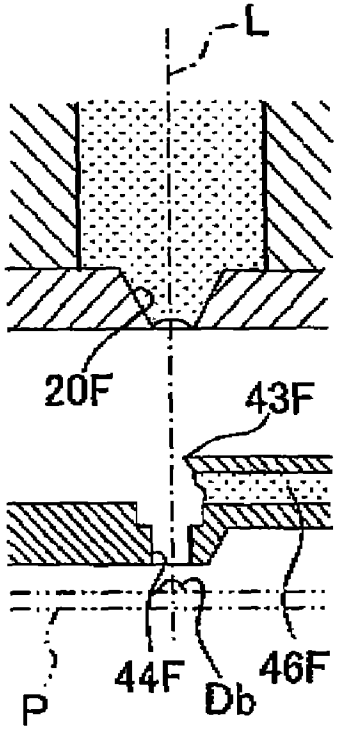
FIG. 20D is a diagram describing the operation of jetting a liquid droplet from the nozzle, in which a state when the satellite liquid droplet is landed on a recording paper is shown.

Furthermore, the front end portion of the main liquid droplet trapping section 43F is inclined in a direction separating away from the axis L of the nozzle 20F, progressively in a downward direction, which is the direction of flying of the liquid droplet. Therefore, the main liquid droplet Da which is jetted from the nozzle 20F first, and trapped by the front end portion of the main liquid droplet trapping section 43F, is moved in the direction going away from the axis L of the nozzle 20F as shown in FIG. 20B, and is recovered by the recovery channel 46F. Consequently, the satellite liquid droplet Db which is flown after the main liquid droplet Da, without being affected by the main liquid droplet Da, is passed through the through hole 44E, and landed on the recording paper P as shown in FIG. 20D. In the sixth embodiment, the nozzle 20F which makes the main liquid droplet Da and the satellite liquid droplet Db fly in the same trajectory of flying corresponds to the flying trajectory setting mechanism used in the invention of this application. According to a structure in the sixth embodiment, for trapping only the main liquid droplet, the flying trajectory of the main liquid droplet and the flying trajectory of the satellite liquid droplet need not be different, and a structure of the ink-jet head becomes simple.

In the embodiment and the modified embodiments described above, the cover member 40 surrounds completely from the sides and the bottom side, the space 28 on the lower side of the nozzle plate 13 in which the satellite liquid droplet flies (refer to FIG. 3). However, by surrounding the space 28 only from the sides, it is possible to suppress considerably a generation of an air flow in the space 28, or flying in of impurities from an outside, and an effect of maintaining the rectilinearity of the satellite liquid droplets is achieved sufficiently. Furthermore, only by shielding the space 28 from at least one of sides by a member in the form of a plate, an effect up to certain extent is achieved.

The space 28 in the cover member 40, and a space in which the satellite liquid droplet has flown out of the cover plate 40, till landing on the recording paper P, may be decompressed. For example, an ink-j et printer may be structured such that the ink-jet printer includes a sub chassis which shields the ink-jet head 1 and a space in which the recording paper P is transported, and a pump which decompresses a space in the sub chassis, and the pump may be operated at least during recording on the recording paper P. In this structure, in the space in which the satellite liquid droplet Db flies, since a flow of a gas which has an effect on the flying trajectory of the satellite liquid droplet Db is small, it is possible to suppress a decline in the accuracy of the landing position. Moreover, the formation may be such that the recording of image etc. is performed with the ink-jet printer as a whole, installed in a decompressed room.

In the embodiment and the modified embodiments described above, the nozzle plate 13 is formed of an electroconductive metallic material. However, the nozzle plate 13 may be formed of a synthetic resin material such as polyimide. In this case, it is possible to form easily a plurality of nozzles by a laser processing (laser machining) in which an excimer laser is used. As in the embodiment described above, when it is necessary to prevent the generation of the electrostatic force between the liquid droplet of the ink and the inner wall of the through holes 44, by letting an electric potential of the liquid droplet of the ink and an electric potential of the inner wall of the through holes 44 in the cover member 40 to be the same, the cover member 40 may be brought into conduction with the metallic plates 10 to 12 except the nozzle plate 13, or the cover member 40 may be grounded directly. Moreover, the entire cover member 40 is not required to be formed of an electroconductive material, and at least (only) an inner wall of each of the through holes 44 may be formed of an electroconductive material. In this case, the inner wall of each of the through holes 44 may be kept at the same electric potential as the electric potential of the ink, by bringing into conduction with the channel unit 2 which is electroconductive, or by grounding directly.

In the embodiment and the modified embodiments described above, a hole is formed in a cover member corresponding to each of the nozzles. However, a position and a shape of the through holes may be voluntary, and for example, one through hole which is long and slender in a direction in which the nozzles are arranged, may be formed corresponding to a plurality of nozzles. Moreover, in the embodiment and the modified embodiment of the present invention, the ink-jet head has one cover member. However, the number of cover members may be voluntary. For example, the ink-jet head may have a plurality of cover members, each corresponding to a different color of ink, or may have a cover member corresponding to each of the nozzles, or a cover member corresponding to each group of a plurality of cover members. Furthermore, a through hole formed in the cover member may be inclined with respect to an axial direction of the nozzle, or may be parallel to the axial direction of the nozzle. Furthermore, a cross-sectional shape of the through holes may be a shape opened toward a direction of advance of the liquid droplet, or conversely, may be a shape tapered toward the direction of advance of the liquid droplet. A highly liquid repellent area (an area in which a wetting angle of a liquid is 90° or more) may by formed around an opening at an exit side in the direction of advance of the liquid droplet, of the through holes formed in the cover member. In this case, a liquid droplet which is adhered to an area near the opening is prevented from entering the through holes. Furthermore, the cover member may be provided such that the cover member is detachable from a channel unit, by a fitting mechanism for example. In this case, it is desirable that a non-return valve is provided, such that a manifold is not exposed to outside air when the cover member is removed. Thus, when the cover member is detachable, at the time of maintenance, it is possible to remove easily ink and dust etc. adhered near the nozzles.

The embodiment and the modified embodiments described above are examples in which the present invention is applied to an ink-jet printer of a serial type (serial ink-jet printer). However, the present invention is (also) applicable to an ink-jet printer of a line type (line ink-jet printer) which is longer in a direction of width of a recording paper.

Moreover, the present invention is also applicable to a liquid droplet jetting apparatus other than the ink-jet printer. For example, the present invention is applicable to various liquid droplet jetting apparatuses which jet a very small liquid droplet, in cases such as forming a very fine wiring pattern on a substrate by jetting an electroconductive paste, or forming a high definition display by jetting an organic light emitting body on a substrate, and furthermore, forming a micro optical device of an optical wave guide, by jetting an optical resin on a substrate.

What is claimed is:

1. A liquid droplet jetting apparatus which jets, onto an object, a main liquid droplet and a satellite liquid droplet which has a volume smaller than a volume of the main liquid droplet, comprising:

a nozzle;

a flying trajectory setting mechanism which sets a flying trajectory of the main liquid droplet jetted from the nozzle and a flying trajectory of the satellite liquid droplet jetted from the nozzle;

a shielding body which shields a space in which the satellite liquid droplet jetted from the nozzle flies, wherein the shielding body comprises a side wall which surrounds the space entirely to suppress an airflow in the space; and a main liquid droplet trapping section which traps only the main liquid droplet, and which is arranged in the space at a position at which the main liquid droplet trapping section makes contact with the main liquid droplet jetted from the nozzle and has no contact with the satellite liquid droplet, wherein the shielding body further comprises a bottom wall which covers the space and which faces the object, wherein the bottom wall has a through hole formed therethrough, which allows only the satellite liquid droplet to pass through, and wherein an inner wall of the shielding body which defines the through hole is formed of an electroconductive material, and the inner wall is kept at an electric potential same as an electric potential of the satellite liquid droplet which is jetted from the nozzle.

2. The liquid droplet jetting apparatus according to claim 1, wherein the main liquid droplet trapping section is formed integrally with the shielding body.

3. The liquid droplet jetting apparatus according to claim 1, wherein the flying trajectory setting mechanism sets the flying trajectory of the satellite liquid droplet and the flying trajectory of the main liquid droplet to be mutually different.

4. The liquid droplet jetting apparatus according to claim 3, wherein the through hole is formed in the shielding body at an area which is in proximity of the main liquid droplet trapping section, and a projection which prevents main liquid droplet, trapped by the main liquid droplet trapping section, from flowing into the through hole is formed in shielding body at an area between the through hole and the main liquid droplet trapping section.

5. The liquid droplet jetting apparatus according to claim 3, wherein a highly liquid-repellent area having a liquid repellent property higher than a liquid repellent property of the main liquid droplet trapping section is formed in the shielding body at an area between the though hole and the main liquid droplet trapping section.

6. The liquid droplet jetting apparatus according to claim 5, wherein an area dimension of the highly liquid-repellent area is narrowed toward the main liquid droplet trapping section.

7. The liquid droplet jetting apparatus according to claim 5, wherein the liquid repellent property of the highly liquid-repellent area is decreased toward the main liquid droplet trapping section.

8. The liquid droplet jetting apparatus according to claim 1, wherein the flying trajectory setting mechanism sets the flying trajectory of the satellite liquid droplet and the flying trajectory of the main liquid droplet to be same, and a front end portion of the main liquid droplet trapping section is arranged in an area, of the space which partially overlaps with the main liquid droplet as viewed from an axial direction of the nozzle and which does not overlap with the satellite liquid droplet as viewed from the axial direction.

9. The liquid droplet jetting apparatus according to claim 1, further comprising a liquid channel which communicates with the nozzle, wherein a recovery channel which communicates with the liquid channel, and which returns the trapped main liquid droplet back to the liquid channel is formed in the main liquid droplet trapping section.

10. The liquid droplet jetting apparatus according to claim 1 further comprising a carriage which moves in a first direction integrally with the nozzle, the flying trajectory setting mechanism, the shielding body and the main liquid droplet trapping section, wherein the side wall is formed at the both end, of the shielding body, in the first direction.

11. A liquid droplet jetting apparatus which jets, onto an object, a main liquid droplet, and a satellite liquid droplet which has a volume smaller than a volume of the main liquid droplet, comprising:

a nozzle;

a flying trajectory setting mechanism which sets a flying trajectory of the main liquid droplet jetted from the nozzle, and a flying trajectory of the satellite liquid droplet jetted from the nozzle;

a flying rectilinearity maintaining mechanism which maintains a rectilinearity of the satellite liquid droplet flying from the nozzle toward the object by decompressing a space, in which the satellite liquid droplet flies toward the object, to suppress an airflow in the space; and a main liquid droplet trapping section which traps only the main liquid droplet, and which is arranged at a position at which the main liquid droplet trapping section makes contact with the main liquid droplet jetted from the nozzle and has no contact with the satellite liquid droplet, wherein the flying rectilinearity maintaining mechanism further comprises a bottom wall which covers the space and which faces the object, wherein the bottom wall has a through hole formed therethrough, which allows only the satellite liquid droplet to pass through, and wherein an inner wall of the flying rectilinearity maintaining mechanism, which defines the through hole, is formed of an electroconductive material, and the inner wall is kept at an electric potential same as an electric potential of the satellite liquid droplet which is jetted from the nozzle.

12. A liquid droplet jetting apparatus which jets, onto an object, a main liquid droplet and a satellite liquid droplet which has a volume smaller than a volume of the main liquid droplet, comprising:

a nozzle;

a liquid channel which communicates with the nozzle;

a shield which shields a space, in which the satellite liquid droplet jetted from the nozzle flies, to suppress an airflow in the space; and a trap which traps only the main liquid droplets, and which is arranged in the space at a position at which the trap makes contact with the main liquid droplet jetted from the nozzle, and has no contact with the satellite liquid droplet, wherein a hole through which only the satellite liquid droplet is passable is formed in the shield, and wherein an inner wall of the shield which defines the hole is formed of an electroconductive material, and the inner wall is kept at an electric potential same as an electric potential of the satellite liquid droplet which is jetted from the nozzle.

13. The liquid droplet jetting apparatus according to claim 12, wherein the trap is formed integrally with the shield.

14. The liquid droplet jetting apparatus according to claim 12, wherein the hole is formed in the shield at an area which is in proximity of the trap, and a projection which prevents main liquid droplet trapped by the trap from flowing into the hole is formed in the shield at an area between the hole and the trap.

15. The liquid droplet jetting apparatus according to claim 12, wherein a highly liquid-repellent area having a liquid repellent property higher than a liquid repellent property of the trap is formed in the shield at an area between the hole and the trap.

16. The liquid droplet jetting apparatus according to claim 15, wherein an area dimension of the highly liquid-repellent area is narrowed toward the trap.

17. The liquid droplet jetting apparatus according to claim 15, wherein the liquid repellent property of the highly liquid-repellent area is decreased toward the trap.

18. The liquid droplet jetting apparatus according to claim 12, wherein a recovery channel which communicates with the liquid channel, and which returns the trapped main liquid droplet back to the liquid channel is formed in the trap.

19. The liquid droplet jetting apparatus according to claim 12, wherein the shield has a bottom wall covering the space and facing the object and a side wall surrounding the space entirely, the shield covering the space entirely except the through hole.

20. The liquid droplet jetting apparatus according to claim 12 further comprising a carriage which moves in a first direction integrally with the nozzle, the liquid channel, the shield and the trap, wherein a side wall is formed at the both end, of the shield, in the first direction.

* * * * *